US012799661B2

(12) United States Patent
Kim et al.

(10) Patent No.: US 12,799,661 B2
(45) Date of Patent: Nov. 17, 2026

(54) LAUNDRY TREATING APPARATUS

(71) Applicant: LG ELECTRONICS INC., Seoul (KR)

(72) Inventors: Younghoon Kim, Seoul (KR); Sungwoon Jung, Seoul (KR); Kunwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 239 days.

(21) Appl. No.: 18/708,500

(22) PCT Filed: Dec. 13, 2022

(86) PCT No.: PCT/KR2022/020202
§ 371 (c)(1),
(2) Date: May 8, 2024

(87) PCT Pub. No.: WO2024/101524
PCT Pub. Date: May 16, 2024

(65) Prior Publication Data

US 2025/0263880 A1 Aug. 21, 2025

(30) Foreign Application Priority Data

Nov. 11, 2022 (KR) ..... 10-2022-0150883

(51) Int. Cl.
*D06F 39/02* (2006.01)
*D06F 21/08* (2006.01)

(52) U.S. Cl.
CPC ..... *D06F 39/02* (2013.01); *D06F 21/08* (2013.01)

(58) Field of Classification Search
CPC ..... D06F 39/02
See application file for complete search history.

(56) References Cited

FOREIGN PATENT DOCUMENTS

| | | | |
|---|---|---|---|
| EP | 3 904 584 | A1 | 11/2021 |
| JP | 7-8315 | B2 | 2/1995 |
| JP | 2002-11282 | A | 1/2002 |
| JP | 2022-522691 | A | 4/2022 |
| JP | 2022-127188 | A | 8/2022 |
| KR | 10-2004-0009946 | A | 1/2004 |
| KR | 10-2010-0066172 | A | 6/2010 |

*Primary Examiner* — Jason Y Ko
(74) *Attorney, Agent, or Firm* — Birch, Stewart, Kolasch & Birch, LLP

(57) ABSTRACT

A laundry treating apparatus includes a mounting portion disposed on a top cover and disposed at the rear of a door or an inlet to deliver detergent to a tub, a storage detachably disposed on the mounting portion to store the detergent therein, and a fixing portion at least partially accommodated inside the storage to be inserted into and withdrawn from the storage. The fixing portion is selectively inserted into the mounting portion to fix the storage to the mounting portion.

20 Claims, 14 Drawing Sheets

[Figure 1]
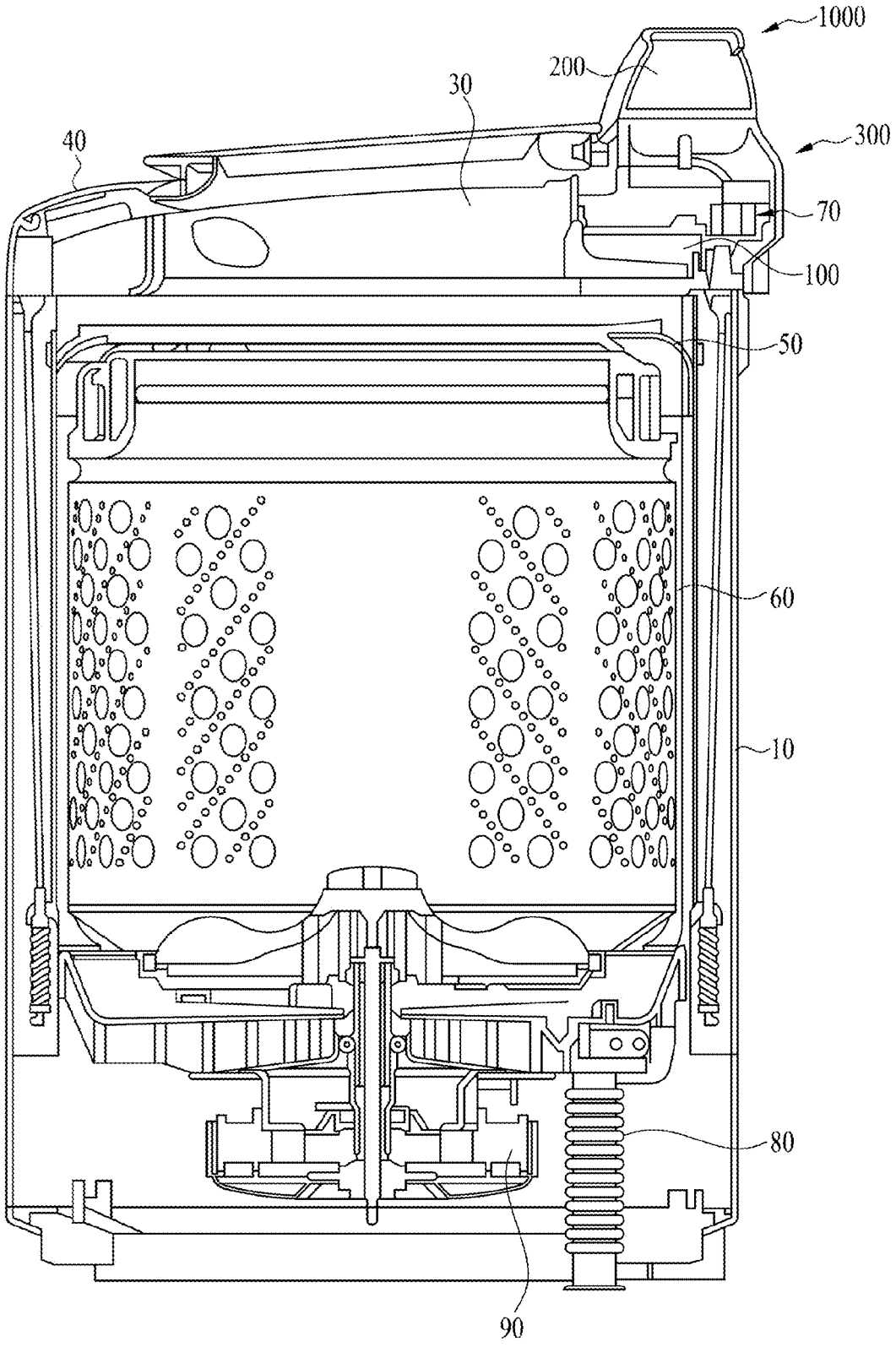

[Figure 2]
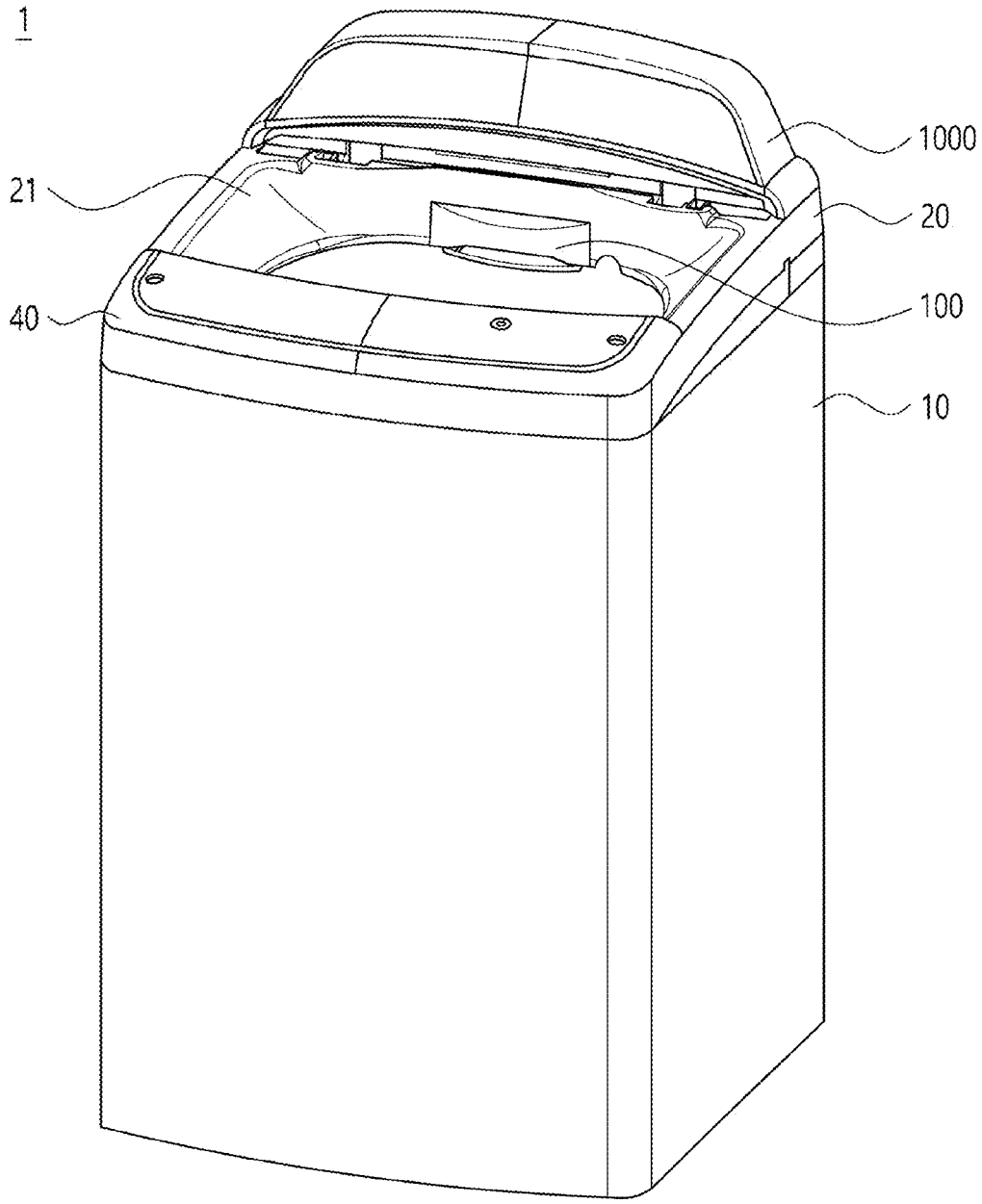

【Figure 3】
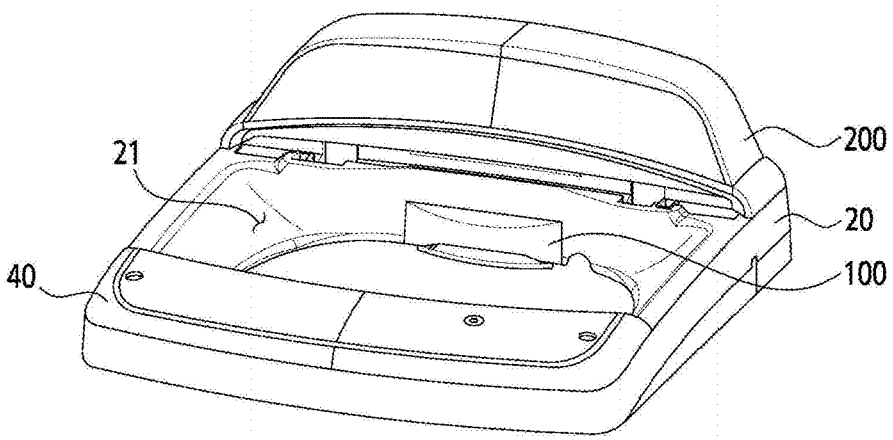

[Figure 4]
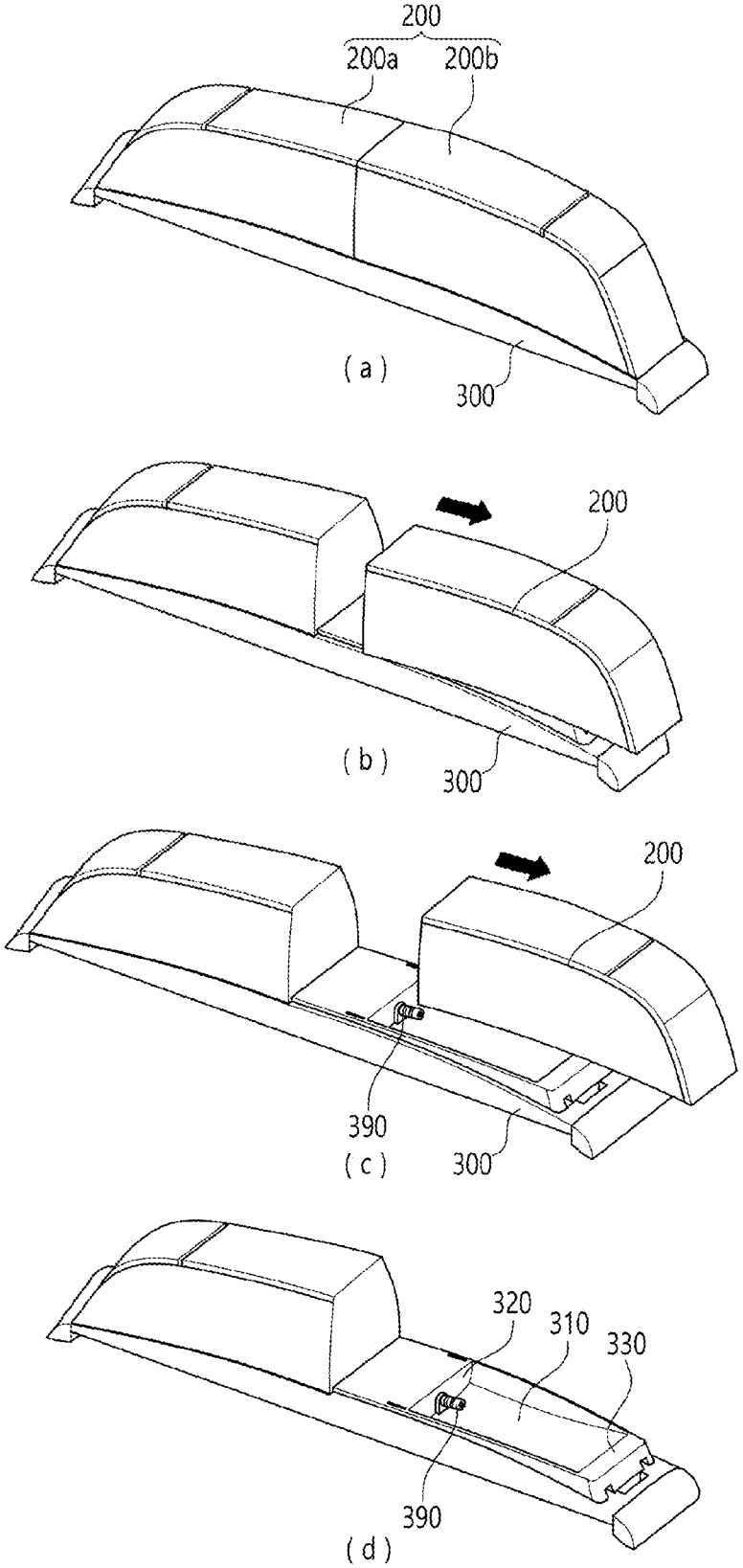

[Figure 5]
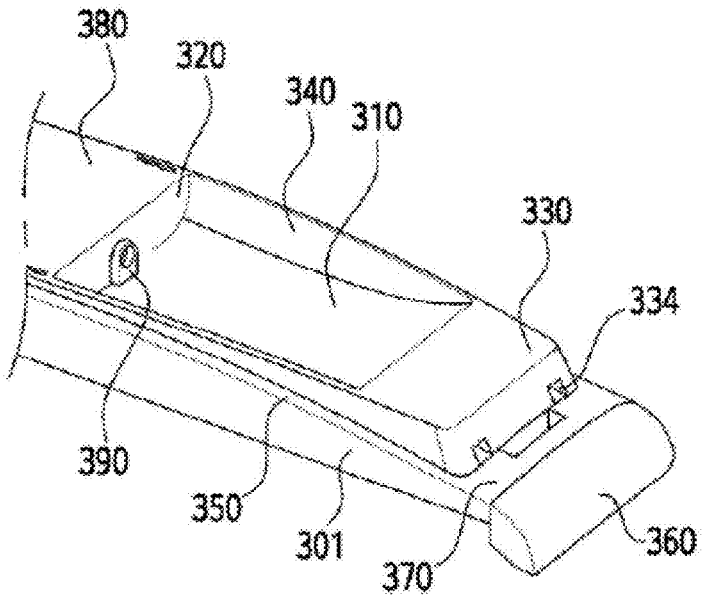
[Figure 6]
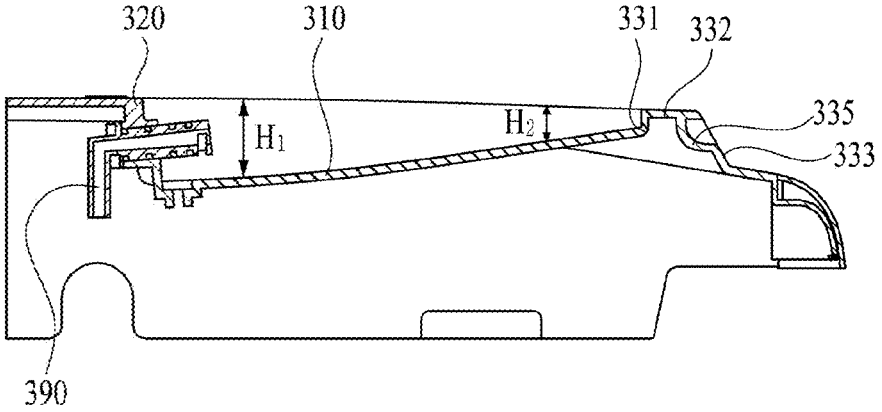

【Figure 7】
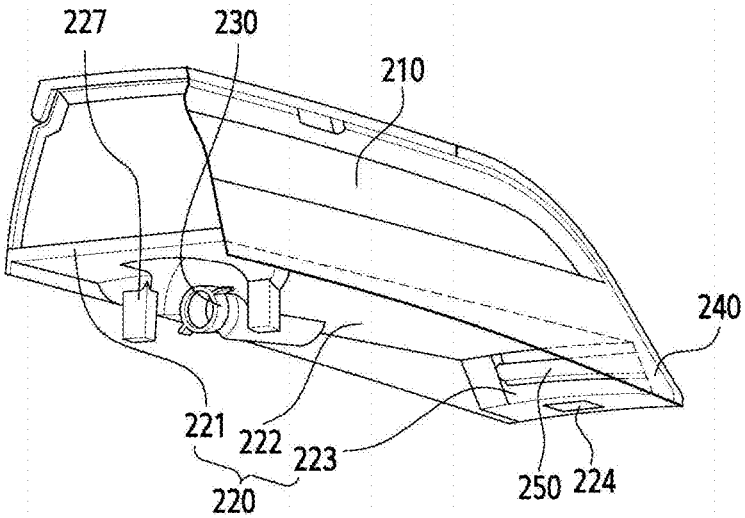
【Figure 8】
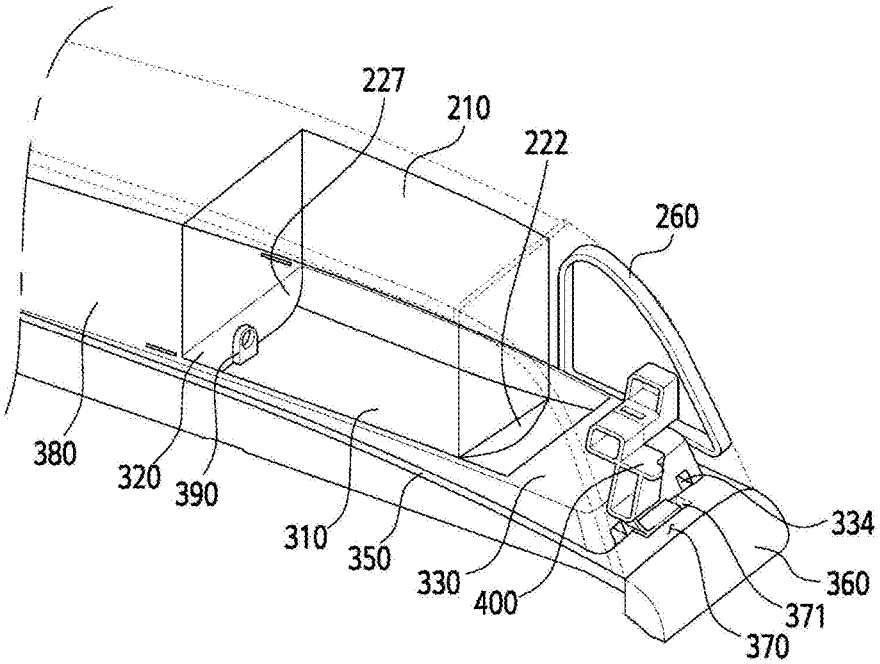

【Figure 9】
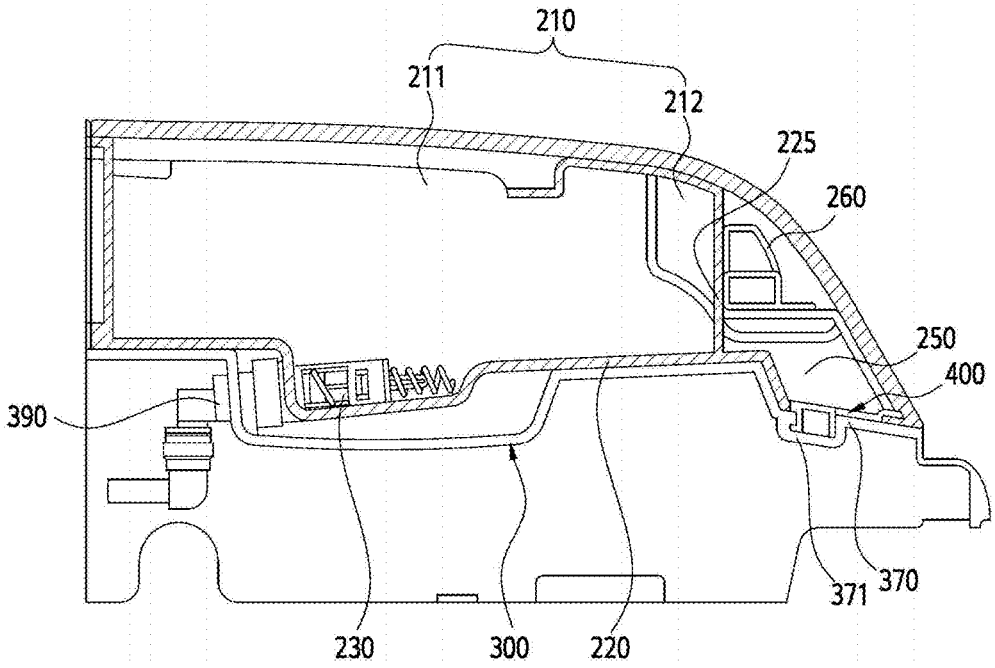

【Figure 10】
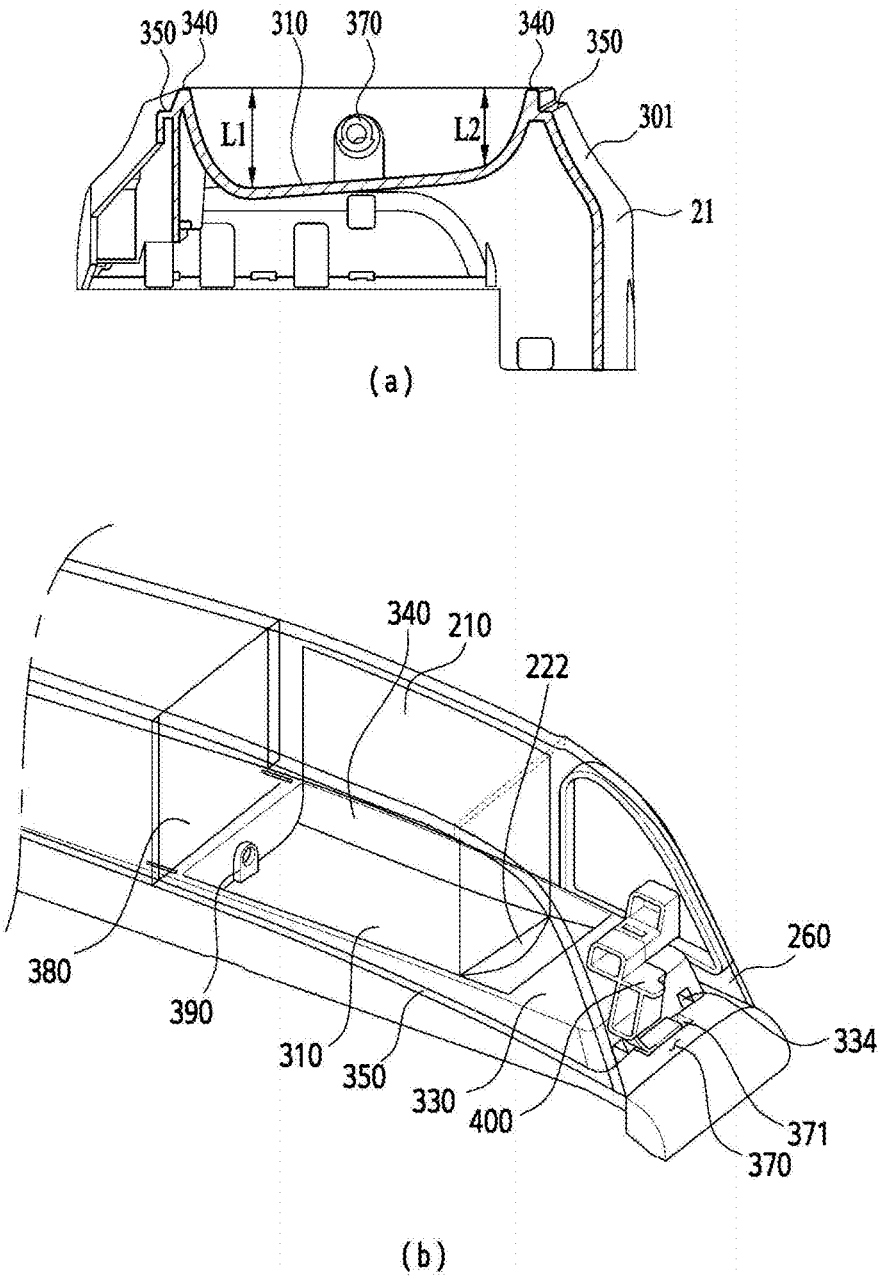

【Figure 11】
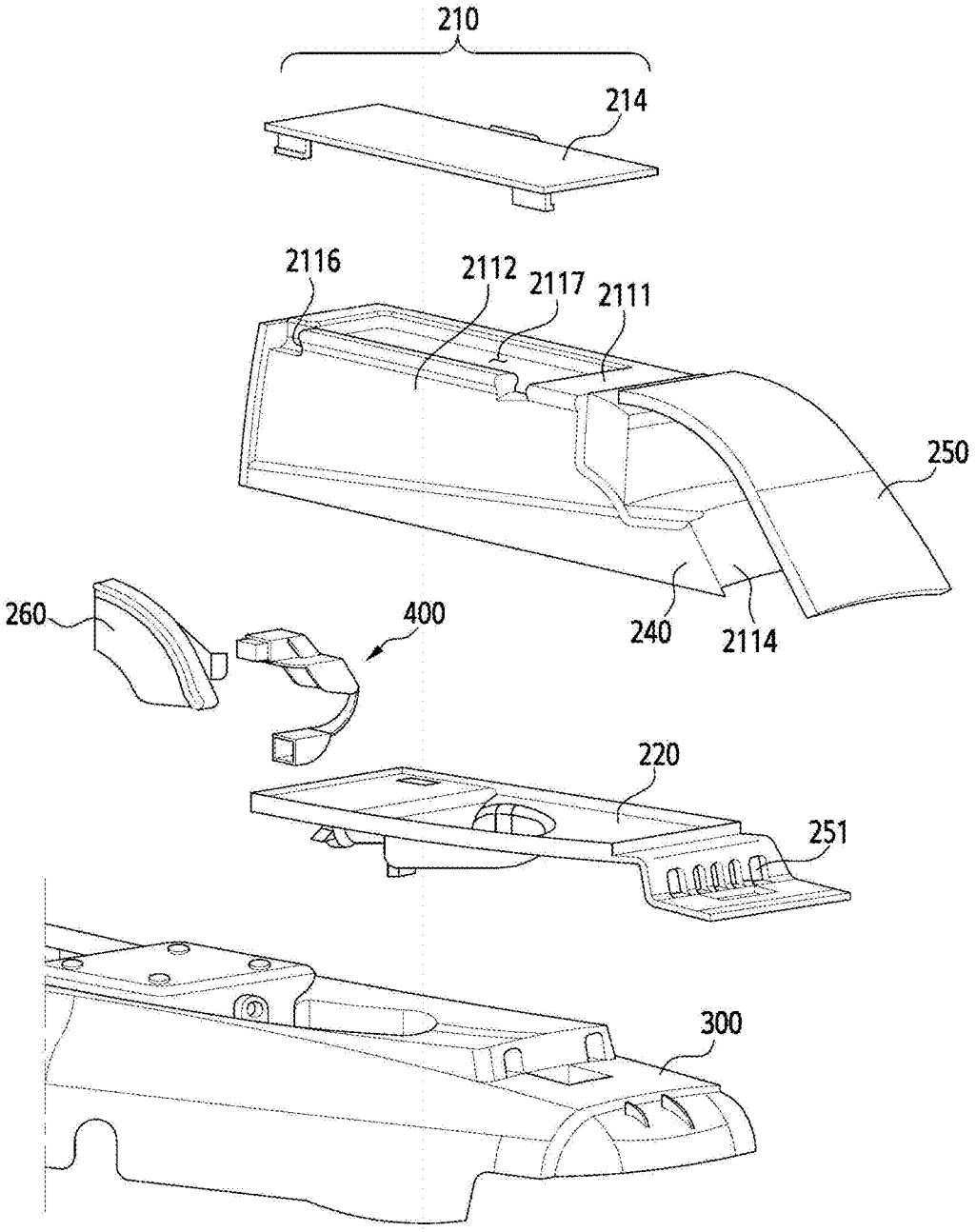

【Figure 12】
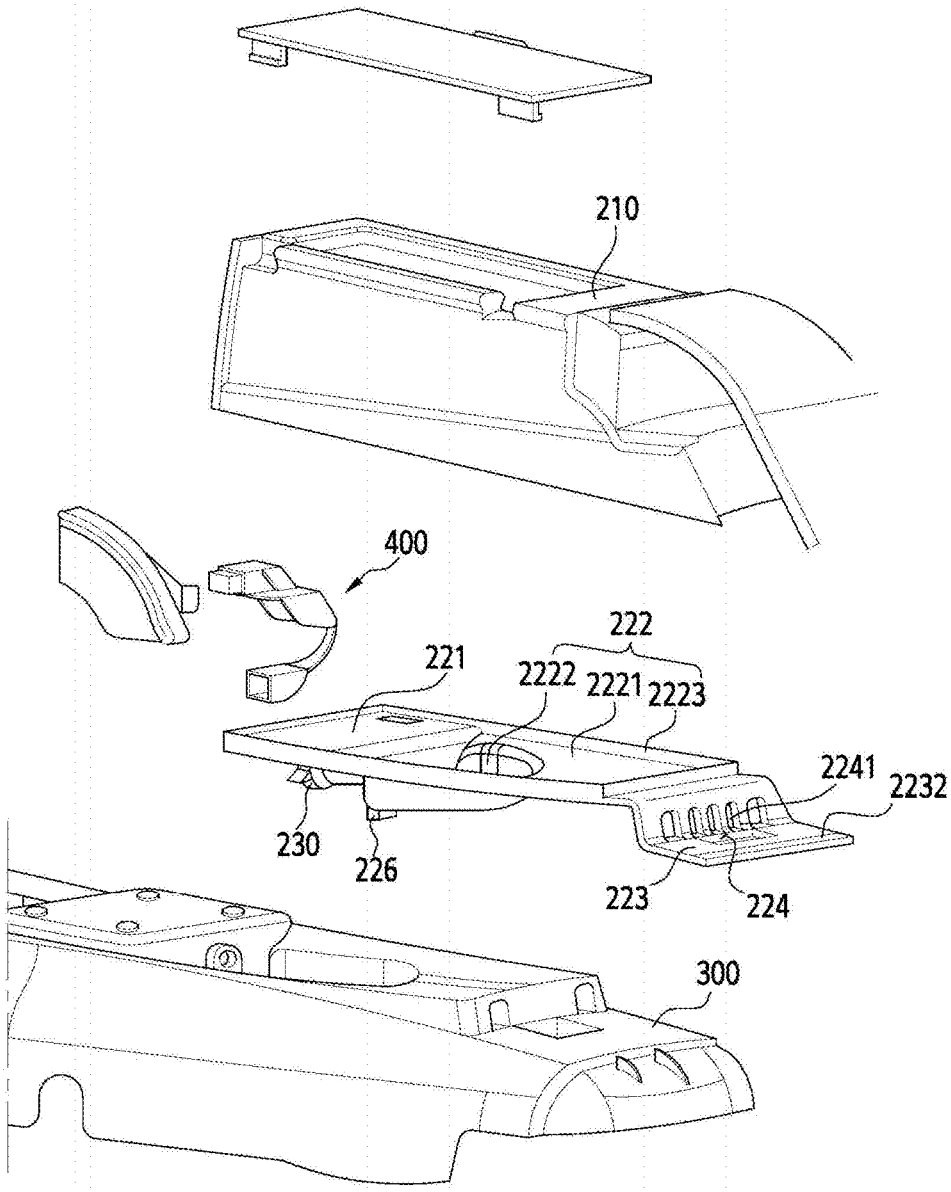

【Figure 13】
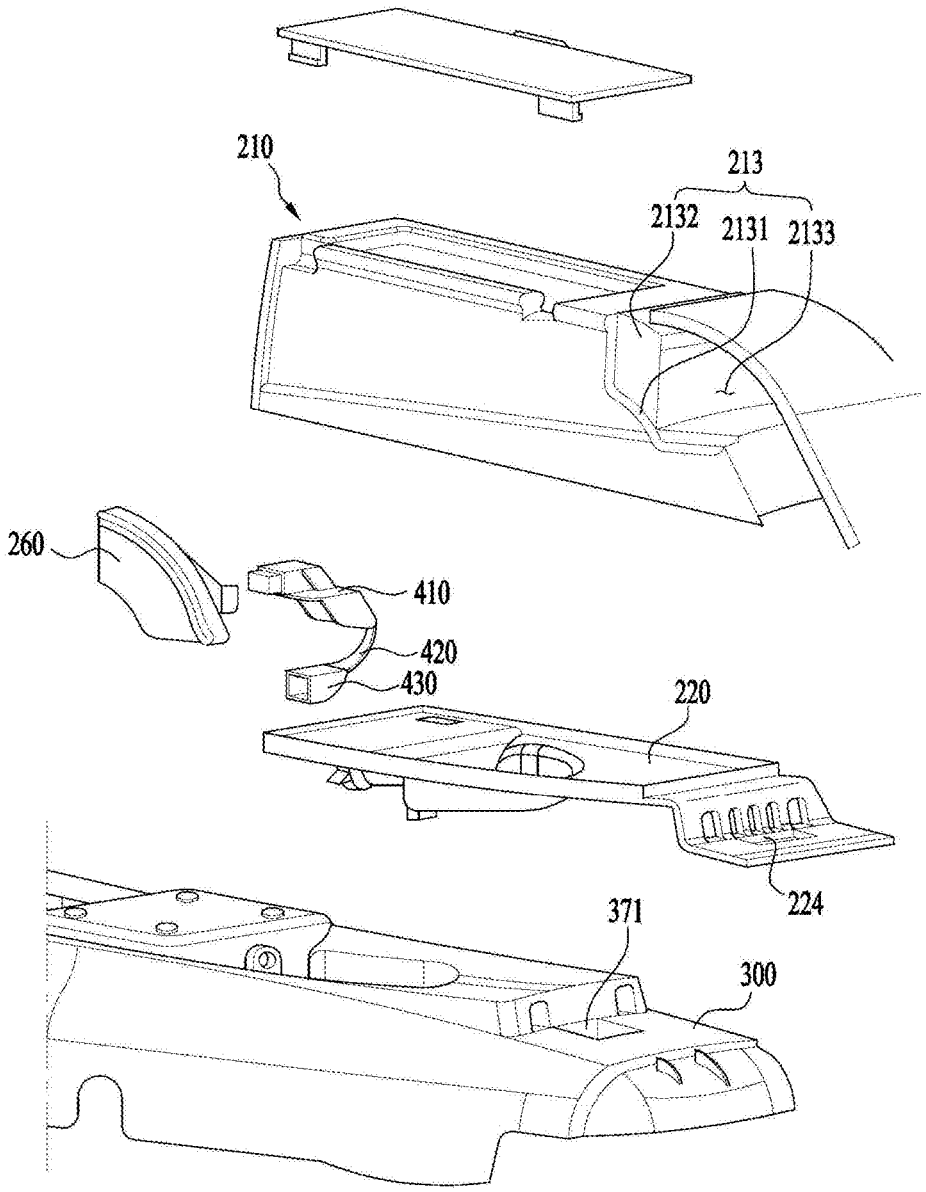

【Figure 14】
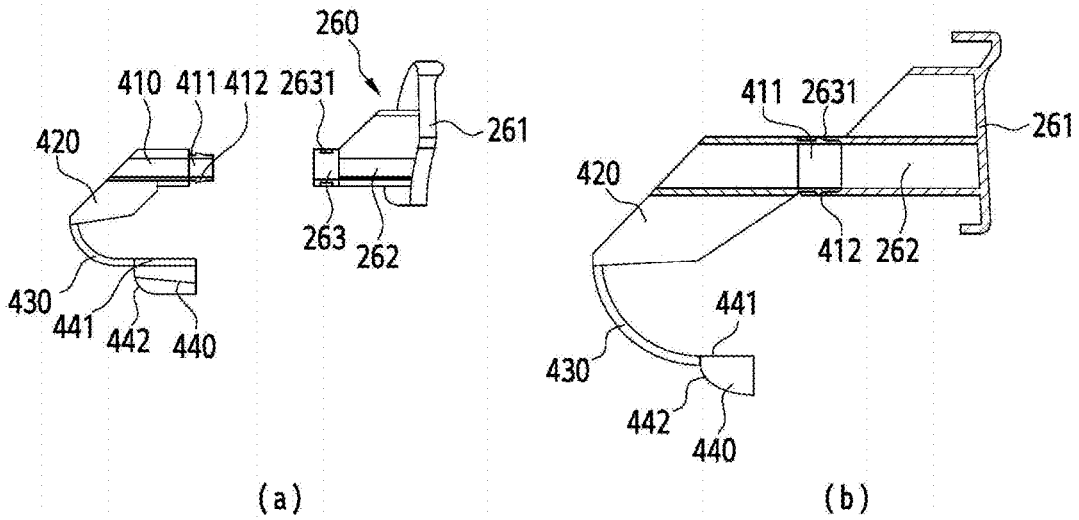

【Figure 15】
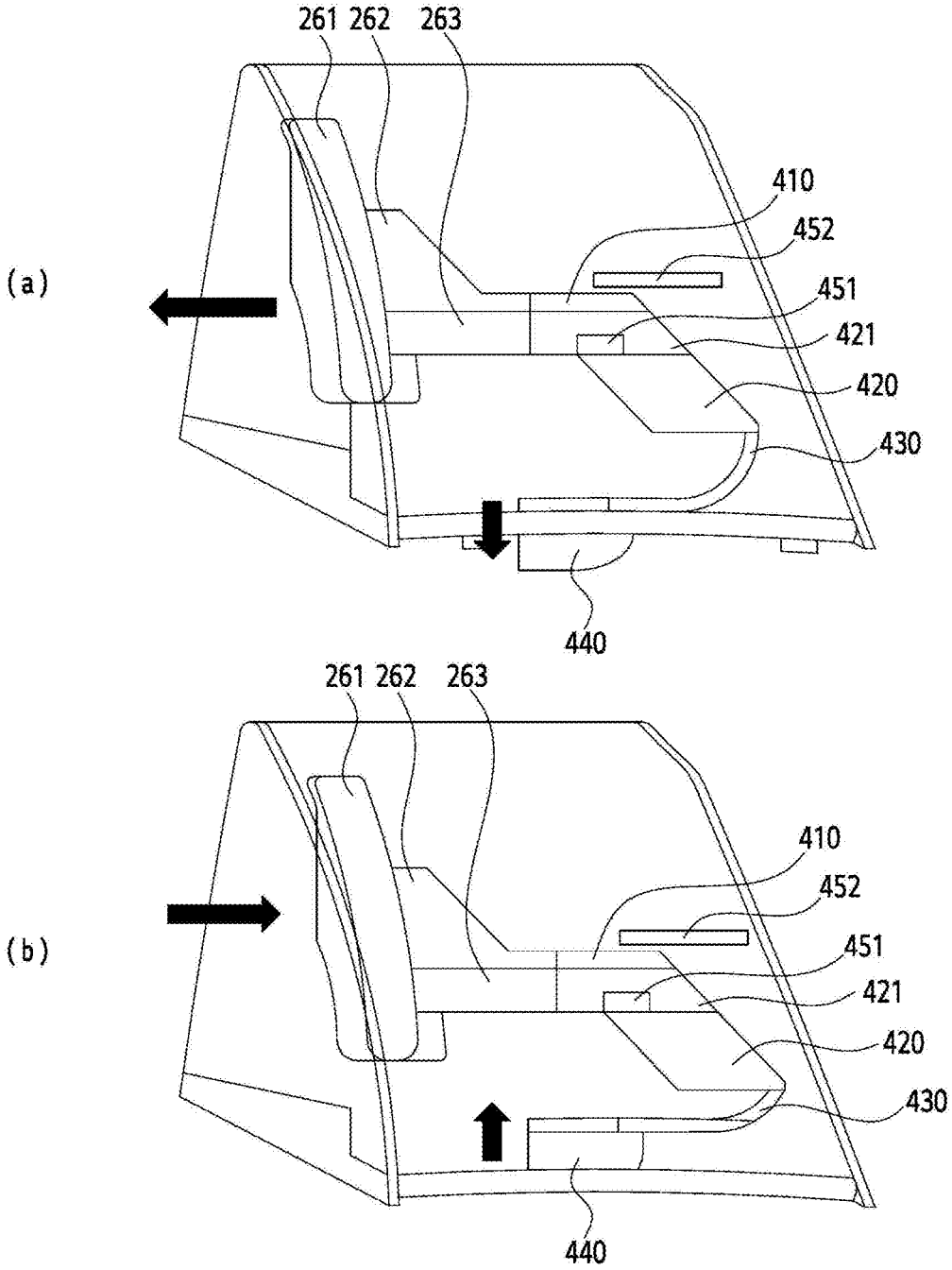

[Figure 16]
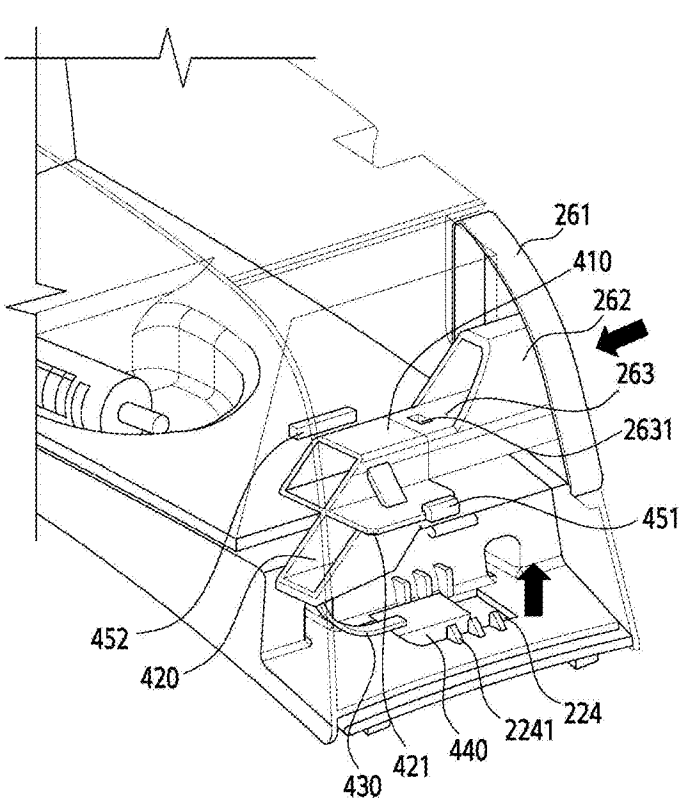
(b)
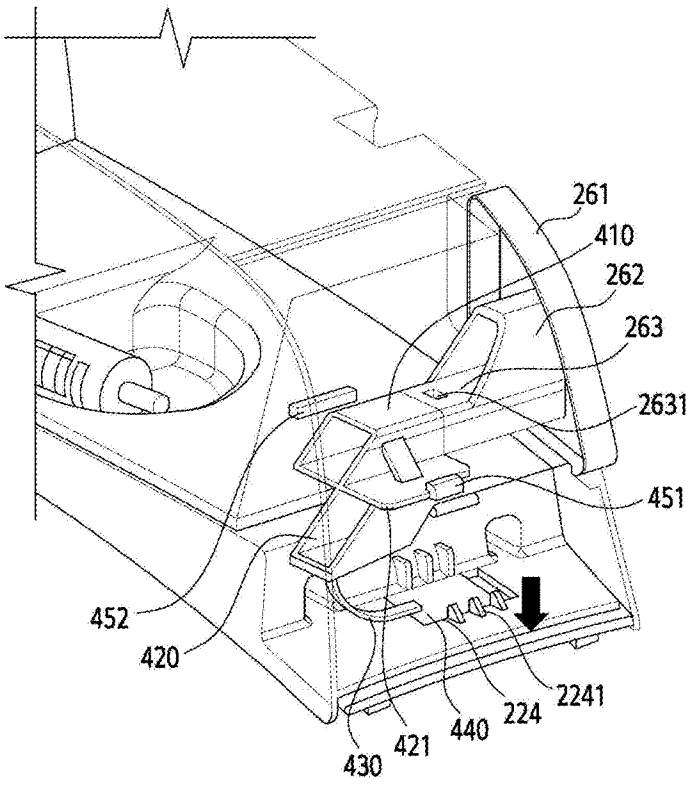
(a)

LAUNDRY TREATING APPARATUS

CROSS REFERENCE TO RELATED APPLICATIONS

This application is the National Phase of PCT International Application No. PCT/KR2022/020202, filed on Dec. 13, 2022, which claims priority under 35 U.S.C. 119 (a) to Patent Application No. 10-2022-0150883, filed in the Republic of Korea on Nov. 11, 2022, all of which are hereby expressly incorporated by reference into the present application.

TECHNICAL FIELD

The present disclosure relates to a laundry treating apparatus.

BACKGROUND

Generally, a laundry treating apparatus is a home appliance that removes foreign substances from laundry using water and detergent, and includes a tub that stores water therein, a water supply that supplies water to the tub, and a detergent supply that is disposed on a flow channel that connects the water supply with the tub and supplies detergent to the tub along with water.

In the existing laundry treating apparatus, the detergent supply was able to be simply formed as a space for storing the detergent, and a scheme in which a user injects the necessary detergent into the detergent supply whenever performing washing of the laundry was applied.

Although such existing laundry treating apparatus was able to guarantee the user autonomy to select a type and an amount of detergent needed, there was a fundamental problem in that it was difficult to expect injection of a necessary appropriate amount of detergent.

In addition, in such laundry treating apparatus, there was inconvenience of having to newly inject the detergent every time the washing is performed because all the detergent stored in the detergent supply is put into the tub when water is supplied to the detergent supply.

To overcome such problem, a laundry treating apparatus in which the detergent supply is controlled by a controller disposed on the laundry treating apparatus to supply the appropriate amount of detergent appeared (see Korean Patent Application Publication No. 2000-0009638).

The existing laundry treating apparatus was equipped with an automatic detergent supply apparatus including a storage in which the detergent supply stores the detergent, and a valve that automatically supplies the detergent contained in the storage to the tub.

Such laundry treating apparatus had an advantage that the controller is able to calculate an optimal amount of detergent based on an amount of the laundry, a water supply amount, and the like, and thus, only the appropriate amount of detergent is able to be supplied to the tub even when a great amount of detergent is stored in the storage.

However, the laundry treating apparatus had a limitation in that the storage is formed integrally with a cabinet or the like, and thus, is not able to be separated. As a result, when the foreign substances are introduced into the storage or the storage is contaminated, the laundry treating apparatus was not able to wash the storage, so that there was a possibility that the automatic detergent supply apparatus may be damaged or the laundry may be contaminated by the detergent stored in the storage.

In particular, the laundry treating apparatus had a fundamental limitation in that it is difficult to perform maintenance and repair because, when the user puts wrong detergent or the foreign substances into the storage, there is no way to easily remove the same.

To overcome such problem, a laundry treating apparatus in which the storage may be separated from the laundry treating apparatus appeared (Korean Patent Application Publication No. 10-2021-0027019).

The laundry treating apparatus was constructed such that the storage may be separated from the flow channel that supplies the detergent and be completely withdrawn to the outside. Therefore, when the storage is contaminated or the foreign substances are introduced thereinto, the storage may be easily cleaned, and when detergents other than detergent suitable for the storage or the foreign substances are introduced, the detergents or the foreign substances may be easily removed.

In one example, a great amount of detergent must be injected into the storage to reduce the number of times the user injects the detergent into the storage. Accordingly, the storage needed to increase in volume to accommodate an amount of detergent to perform multiple washing cycles.

The existing laundry treating apparatus was equipped with a drawer type housing that accommodates therein and supports an entirety of the storage so as to stably support the heavy and bulky storage.

The housing had all closed surfaces except for an open surface from which the storage is extended to support four or more surfaces of the storage. As a result, the existing laundry treating apparatus was able to stably support the storage even when great vibration occurs.

However, for the automatic detergent supply apparatus to be formed to completely accommodate the storage in the housing (hereinafter, referred to as the drawer type), it was common that the laundry treating apparatus is of a front load type in which an opening through which the laundry is introduced is defined at the front, like the existing laundry treating apparatus.

The front load type washing machine has a drum that accommodates the laundry therein and is constructed to rotate about a rotation axis parallel to or slightly inclined to the ground, and the tub accommodating the drum therein is also formed in a cylindrical shape oriented in a front and rear direction. Therefore, the existing front load type washing machine had an advantage that a space in which the drawer type automatic detergent supply apparatus may be installed may be secured at a front edge of the cabinet.

In particular, because the front load type washing machine does not have a door on a top surface, there was also an advantage that the separate automatic detergent supply apparatus may be installed at the top of the cabinet.

However, such drawer type automatic detergent supply apparatus had a problem of being difficult to be applied to a top load type washing machine in which a laundry inlet is defined at the top of the cabinet.

Nevertheless, recently, a laundry treating apparatus in which the drawer type automatic detergent supply apparatus is equipped in the top load type washing machine appeared (see Korea Patent Application Publication No. 10-2018-0080013).

In the laundry treating apparatus, the drawer type automatic detergent supply apparatus was applied to the top load type washing machine equipped with the opening through which the laundry is introduced defined at the top of the cabinet and the door that opens and closes the opening.

In the top load type washing machine, because a suspension supporting the tub or the like is fixed to a corner of the cabinet, it is difficult to install the automatic detergent supply apparatus inside the cabinet, or even when the automatic detergent supply apparatus is installed, it is difficult to expand a capacity of the storage or to install a water supply flow channel.

In addition, in the top load type washing machine, when the automatic detergent supply apparatus is disposed in front of the door or the opening, the automatic detergent supply apparatus disturbs putting the laundry into the opening or opening the door.

Therefore, in the existing laundry treating apparatus, the automatic detergent supply apparatus was disposed at the rear of the door or the opening and the automatic detergent supply apparatus was of the drawer type where the storage is extended forward.

However, installation of a pump that discharges the detergent stored in the storage or a connection portion that connects the pump with the storage is essential in the automatic detergent supply apparatus. When the automatic detergent supply apparatus is of the drawer type, the pump or the connection portion must be installed on a surface opposite to a surface where the storage is retracted. As a result, the storage must be spaced forwardly apart from a rear surface of the laundry treating apparatus as much as a space where the pump or the connection portion should be installed.

That is, when the drawer type automatic detergent supply apparatus that is extended forward is installed in the top load type washing machine like the existing laundry treating apparatus, all of the storage and the pump/the connection portion must be installed in a space from a rear side of the cabinet to a rear surface of the inlet or the door. As a result, the existing laundry treating apparatus had a fundamental problem in that an area size of the opening or the door is reduced, making the introduction and withdrawal of the laundry inconvenient.

Moreover, the existing laundry treating apparatus has a problem in that it is difficult to sufficiently secure a thickness of the storage in the front and rear direction even when the area size of the opening or the door is reduced, and thus the volume of the storage is not able to be sufficiently expanded.

To solve such problem, a drawer type automatic detergent supply apparatus in which the storage is extended upward in the top load type washing machine may be considered. In this case, the pump/the connection portion will be disposed under the storage, so that the width of the storage in the front and rear direction is sufficiently secured and the area size of the opening is not reduced.

However, in the top load type washing machine, the automatic detergent supply apparatus must be disposed rearward of the opening, making it difficult for the user to access the automatic detergent supply apparatus. In such situation, when the storage is constructed to be extended upward, there is a problem that a physical condition of a regular user is not suitable for completely extending the storage to an upper end of the drawer.

To resolve such problem, a drawer type automatic detergent supply apparatus that has the storage extended laterally in the top load type washing machine may be considered.

In this regard, it may be easy to extend the storage laterally, but the extending direction of the storage must be maintained until the storage is completely extended from the drawer.

Therefore, when a wall is disposed or another home appliance is disposed on a side surface of the laundry treating apparatus and thus a length for the storage to be extended is not secured, retraction and extension of the storage becomes completely impossible.

As a result, in prior art, there was the fundamental limitation in installing the automatic detergent supply apparatus of the drawer type in the top load type washing machine.

In one example, it may be considered that the automatic detergent supply apparatus is coupled to the top load type washing machine in a slide scheme rather than the drawer type. In other words, a scheme in which the storage is mounted on a mounting portion disposed at the rear of the door or the opening on the cabinet in an exposed state may be considered.

In this case, there is an advantage that a retraction/extension direction of the storage is not limited by a shape or the like of the drawer and thus the storage is easily mounted on the mounting portion.

For example, a scheme of coupling the storage to the mounting portion disposed at the rear of the door on a top surface of the cabinet by inserting the storage downward may be considered. In this case, as a depth at which the storage is inserted downward increases, the storage may be stably fixed to the mounting portion, but it may become difficult to extend the storage from the mounting portion as much.

Therefore, a scheme in which the storage slides by a certain length inward from a side surface of the mounting portion and is coupled to the mounting portion may be considered. In this case, there is an advantage that the storage may be easily mounted on and removed from the mounting portion, but there is also a limitation that the storage may be arbitrarily separated from the mounting portion when vibration or the like occurs.

As a result, in the top load type washing machine, the scheme in which the storage slides in a width direction of the cabinet in the state where the storage is exposed on the cabinet and is mounted on the mounting portion is the easiest and highly applicable for attachment and detachment of the storage.

However, the easier it is to install the storage on the mounting portion, the easier it is for the storage to be separated from the cabinet, so that research is needed to make mounting the storage easy and stably fixing the storage.

SUMMARY

Technical Problem

The present disclosure is to provide a laundry treating apparatus in which a storage that stores detergent therein is stably fixed outside a cabinet in a detachable manner in a state of being exposed to the outside in an automatic detergent supply apparatus of a top load type washing machine.

The present disclosure is to provide a laundry treating apparatus in which the storage in the top load type washing machine may be fixed and separated outside the cabinet in a scheme of sliding in a width direction, but may remain fixed despite vibration or the like.

The present disclosure is to provide a laundry treating apparatus in which the storage in the top load type washing machine may not be separated arbitrarily even when the storage is detachably coupled to the cabinet in the scheme of sliding in the width direction.

The present disclosure is to provide a laundry treating apparatus in which the storage in the top load type washing machine may be firmly coupled to the cabinet in the scheme of sliding in the width direction, but may be easily separated based on an intention of a user.

Technical Solutions

Provided is a laundry treating apparatus including a mounting portion disposed on a top cover and disposed at the rear of a door or an inlet to deliver detergent to a tub, a storage detachably disposed on the mounting portion to store the detergent therein, and a fixing portion at least partially accommodated inside the storage to be inserted into and withdrawn from the storage, wherein the fixing portion is selectively inserted into the mounting portion to fix the storage to the mounting portion.

In one implementation, the storage may be detachable from the mounting portion in a width direction of the top cover.

In one implementation, the mounting portion may include a mounting body disposed on the top cover and disposed at the rear of the door or the inlet, and a restricting surface disposed at an inner side or one end of the mounting body to support the storage.

In one implementation, the storage may include a storage body seated on the mounting portion to store the detergent therein, and a push portion disposed on the storage body and at least partially exposed to the outside of the storage body, and a pressed direction of the push portion and a moving direction of the fixing portion may be perpendicular to each other.

In one implementation, the push portion may be disposed on one surface of the storage body so as to be pressed in a front and rear direction of the top cover, and the fixing portion may be withdrawn from the mounting portion in a height direction when the push portion is pressed.

In one implementation, the fixing portion may include a fixing body coupled to the push portion, a locking hook disposed downwardly of the fixing body to be selectively inserted into the mounting portion, and an elastic portion disposed to connect the fixing body with the locking hook.

In one implementation, the locking hook may be disposed rearwardly of the fixing body.

In one implementation, the storage may further include a plate disposed under the storage body and seated on the mounting portion, a hook insertion hole defined in the plate, wherein the locking hook is inserted and withdrawn through the hook insertion hole, and guide ribs disposed on both sides of the hook insertion hole to guide the locking hook to move only in a height direction.

In one implementation, the fixing portion may further include a prevention rib disposed at both sides of the fixing body to guide the push portion or the fixing body to move only in a front and rear direction.

In one implementation, the locking hook may further include a movable surface slidable in a front and rear direction on the mounting portion.

In one implementation, the storage may include a discharge portion disposed at one side or an inner side of the storage body and in communication with and detachably coupled to the mounting portion, and the push portion may be disposed at the other side or an outer side of the storage body.

In one implementation, the mounting portion may further include an insertion groove defined as at least a portion of a top surface of the mounting portion facing the storage body is recessed, wherein the fixing portion is inserted into the insertion groove.

In one implementation, the mounting portion may further include a mounting groove supporting a lower portion of the storage body, a communication portion disposed at one side or an inner side of the mounting groove and detachably coupled to the storage body to receive the detergent, a bump protruding to the other side of the mounting groove to prevent the storage from deviating, and an outer support surface extending outwardly of the bump and supporting the storage, and the insertion groove may be defined at the other side or an outer side of the mounting groove.

In one implementation, the insertion groove may be defined in the outer support surface.

In one implementation, a recessed direction of the insertion groove may be perpendicular to the pressed direction of the push portion.

Advantageous Effects

According to the present disclosure, the storage that stores the detergent therein is stably fixed outside the cabinet in the detachable manner in the state of being exposed to the outside in the automatic detergent supply apparatus of the top load type washing machine.

According to the present disclosure, the storage in the top load type washing machine may be fixed and separated outside the cabinet in the scheme of sliding in the width direction, but may remain fixed despite the vibration or the like.

According to the present disclosure, the storage in the top load type washing machine may not be separated arbitrarily even when the storage is detachably coupled to the cabinet in the scheme of sliding in the width direction.

According to the present disclosure, the storage in the top load type washing machine may be firmly coupled to the cabinet in the scheme of sliding in the width direction, but may be easily separated based on the intention of the user.

BRIEF DESCRIPTION OF THE DRAWINGS

FIG. 1 shows a configuration of a laundry treating apparatus according to the present disclosure.

FIG. 2 shows an outer appearance of a laundry treating apparatus according to the present disclosure.

FIG. 3 shows a structure of a top cover of a laundry treating apparatus according to the present disclosure.

FIG. 4 shows an embodiment in which a storage of a laundry treating apparatus according to the present disclosure is detached from a mounting portion.

FIG. 5 shows a structure of a mounting portion of a laundry treating apparatus according to the present disclosure.

FIG. 6 shows a cross-sectional view of the mounting portion.

FIG. 7 shows a structure of a storage of a laundry treating apparatus according to the present disclosure.

FIG. 8 shows a width direction fixing structure of an automatic detergent supply apparatus in a laundry treating apparatus according to the present disclosure.

FIG. 9 shows a cross-sectional view of the storage mounted on the mounting portion.

FIG. 10 shows a structure in which the storage is fixed to the mounting portion in a front and rear direction.

FIG. 11 shows an exploded perspective view of the storage body of the storage.

FIG. 12 shows an exploded perspective view of the plate of the storage.

FIG. 13 shows a structure in which the fixing portion is installed in the storage.

FIG. 14 shows a detailed structural embodiment of the fixing portion.

FIG. 15 shows an operating scheme of the fixing portion.

FIG. 16 shows a process in which the storage is separated from the mounting portion.

BEST MODE

Hereinafter, embodiments disclosed herein will be described in detail with reference to the attached drawings. As used herein, identical and similar components will be assigned with identical and similar reference numbers, and the description thereof will be replaced with the first description. As used herein, a singular expression includes a plural expression unless the context clearly dictates otherwise. Additionally, in describing the embodiment disclosed herein, when it is determined that a detailed description of related known technology may obscure the gist of the embodiment disclosed herein, the detailed description will be omitted. In addition, it should be noted that the attached drawings are only intended to facilitate understanding of the embodiments disclosed herein, and should not be construed as limiting the technical idea disclosed herein by the attached drawings.

FIG. 1 shows a configuration of a laundry treating apparatus according to the present disclosure.

A laundry treating apparatus 1 according to the present disclosure may perform a washing course to remove foreign substances from laundry with water and detergent.

The laundry treating apparatus according to the present disclosure may include a cabinet 10 that forms an outer appearance of the apparatus, a tub 50 disposed inside the cabinet 10 to store water therein, a drum 60 rotatably disposed inside the tub 50 to accommodate the laundry therein, and a driver 90 coupled to the tub 50 to rotate the drum 60.

The cabinet 10 may have an opening defined therein through which the laundry is introduced at the top, and each of the tub 50 and the drum 60 may have an inlet through which the laundry is introduced at the top.

Additionally, the driver 90 may be fixed to a bottom surface of the tub 50 and rotate the drum 60.

The laundry treating apparatus according to the present disclosure may further include a suspension that supports the tub 50 inside the cabinet 10, and the suspension may be composed of a damper, a spring, and the like that connect a lower portion of the tub 50 with an upper inner portion of the cabinet 10.

The laundry treating apparatus according to the present disclosure may include a water supply 70 that is disposed at a rear portion of the cabinet 10 and supplies water to the tub 50 by being in communication with an external water supply source, and a drainage 80 that discharges water contained in the tub 50 to the outside of the cabinet 10 by being in communication with a lower portion of the tub 50.

The laundry treating apparatus according to the present disclosure may include one or more of a manual detergent supply apparatus 100 and an automatic detergent supply apparatus 1000 that supply detergent to the tub 50.

The manual detergent supply apparatus 100 may be constructed to allow a user to directly add the detergent.

The manual detergent supply apparatus 100 is constructed such that the water supply 70 and the tub 50 are in communication with each other, so that the introduced detergent is entirely supplied to the tub 50 as water supplied from the water supply 70 is received. As a result, the manual detergent supply apparatus 100 is constructed such that an appropriate amount of detergent is received directly from the user each time the course is performed.

The automatic detergent supply apparatus 1000 may be constructed to store a great amount of detergent to be supplied to the tub 50. That is, the automatic detergent supply apparatus 1000 may be constructed such that an amount of detergent capable of performing the course a plurality of times is stored at once and the appropriate amount of detergent is discharged to the tub 50 each time the course is performed.

Unlike the manual detergent supply apparatus 100, the automatic detergent supply apparatus 1000 may be constructed not to receive water from the water supply 70. That is, because the automatic detergent supply apparatus 1000 does not receive water from the water supply 70, even when the great amount of detergent is stored, the detergent may be prevented from being entirely discharged with water supplied to the water supply 70.

A downstream portion of the automatic detergent supply apparatus 1000 may be in communication with the water supply 70 or the tub 50, but an upstream portion thereof may not be in communication with the water supply 70.

The laundry treating apparatus according to the present disclosure may include both the manual detergent supply apparatus 100 and the automatic detergent supply apparatus 1000 or may include only one of them.

When both the manual detergent supply apparatus 100 and the automatic detergent supply apparatus 1000 are disposed, the manual detergent supply apparatus 100 and the automatic detergent supply apparatus 1000 may be constructed such that respective downstream portions thereof are in communication with each other, thereby simplifying a flow channel structure.

FIG. 2 shows an embodiment of an outer appearance of a laundry treating apparatus according to the present disclosure.

The laundry treating apparatus 1 according to the present disclosure may include a top cover 20 coupled to an upper portion of the cabinet 10. The top cover 20 may form a top surface of the laundry treating apparatus 1 and may have the opening through which the laundry is introduced.

A control panel 40 having an input unit that receives a command to perform the course, and a display that may externally display a state of the course being performed, a state of the automatic detergent supply apparatus 1000, and the like may be installed on the top cover 20.

The top cover 20 may be made of a material different from that of the cabinet 10.

Accordingly, even when the cabinet 10 is made of a metal material to ensure durability, the top cover 20 may be made of a resin or the like to simply a complex structure or to facilitate coupling of another component.

For example, a door 30 that opens and closes the opening may be pivotably coupled to the top cover 20.

The automatic detergent supply apparatus 1000 may store a greater amount of detergent as a volume thereof increases, thereby reducing the number of times the user fills the automatic detergent supply apparatus 1000 with the detergent.

In one example, the automatic detergent supply apparatus 1000 may be detachably installed in the laundry treating apparatus 1 according to the present disclosure. As a result, the automatic detergent supply apparatus 1000 may be easily cleaned by the user and may be easily replaced even when detergent that the user does not want or the foreign substances are introduced thereinto.

In one example, because the suspension is disposed at a corner of the cabinet 10 and the tub 50 is disposed adjacent to an inner upper end of the cabinet 10 in a height direction, there is not enough space to install the automatic detergent supply apparatus 1000 inside the cabinet 10.

Therefore, the automatic detergent supply apparatus 1000 may be disposed outside the cabinet 10 and expanded to have a sufficient volume without being restricted by an internal space of the cabinet 10.

The automatic detergent supply apparatus 1000 may be coupled to the top cover 20 so as to be exposed to the outside. As a result, the automatic detergent supply apparatus 1000 may be easily separated from and installed on the top cover 20.

In one example, when the automatic detergent supply apparatus 1000 is disposed in front of or at both side surfaces of the door 30 or the opening, the automatic detergent supply apparatus 1000 may disturb opening the door 30 or putting the laundry into the opening.

Accordingly, the automatic detergent supply apparatus 1000 may be disposed at the rear of the door 30 or the opening. As a result, the user may open the door 30 or put the laundry into the opening without being disturbed by the automatic detergent supply apparatus 1000. Additionally, the automatic detergent supply apparatus 1000 may support the open door 30, preventing excessive opening of the door 30 at the opening.

In one example, because the driver 90 is disposed under the tub 50, when the laundry treating apparatus according to the present disclosure vibrates, the top cover 20 may vibrate the most. Because the automatic detergent supply apparatus 1000 may accommodate the great amount of detergent therein, a weight thereof is great and thus an inertial force thereof is also great. In such situation, when the automatic detergent supply apparatus 1000 is detachably coupled to top cover 20 from above, vibration with the greatest amplitude is transmitted to the automatic detergent supply apparatus 1000 among the components of the laundry treating apparatus, so that there may be a high possibility that the automatic detergent supply apparatus 1000 is randomly separated from the top cover 20.

Therefore, the automatic detergent supply apparatus 1000 may be completely accommodated in a housing disposed in the top cover and may be of a drawer type extended to the outside from one surface of the housing.

However, when the automatic detergent supply apparatus 1000 is of the drawer type in a state coupled to a portion at the rear of the door 30 in the top cover 20, a surface from which the automatic detergent supply apparatus 1000 is extended from the housing may correspond to one of a top surface, a side surface, and a front surface.

Because a top load type washing machine has a height greater than a width to secure washing capacity, it is very difficult for the user to completely extend and retract the automatic detergent supply apparatus from and into the housing of the top cover 20 in a vertical direction. Additionally, because the automatic detergent supply apparatus is disposed at the rear of the door 30, it may be very difficult for the user to extend and retract the automatic detergent supply apparatus from and into the housing of the top cover 20 in the vertical direction.

In addition, it may be easier for the user to extend and retract the automatic detergent supply apparatus from and into the side surface of the housing of the top cover 20 than to extend and retract the automatic detergent supply apparatus in the vertical direction.

However, for the automatic detergent supply apparatus to be fully extended from the housing, a space for the extension is required from the side surface as much as a length of the automatic detergent supply apparatus. Therefore, when the space where the laundry treating apparatus is disposed is narrow and the length for the automatic detergent supply apparatus to be extended is not secured, there is a problem in which the user is not able to utilize the automatic detergent supply apparatus itself.

In addition, the configuration in which the automatic detergent supply apparatus is extended and retracted in a front and rear direction from and into the top cover 20 may always ensure the length for the automatic detergent supply apparatus to be extended.

However, for the automatic detergent supply apparatus to be coupled to the housing and be in communication with the tub, a pump or a hose to be coupled to and be in communication with the automatic detergent supply apparatus is essential at a rear surface of the housing facing away the surface into which the automatic detergent supply apparatus is inserted.

Therefore, because the automatic detergent supply apparatus must be disposed forwardly of the pump or the hose, an additional space for installing the pump or the hose must be secured at the rear of the door 30 and the inlet. As a result, the volume of the automatic detergent supply apparatus may not be secured sufficiently. When a length in the retraction/extension direction is extended sufficiently to secure the volume of the automatic detergent supply apparatus, an area size of the opening becomes smaller and thus input and withdrawal of the laundry become difficult, or the opening and the door 30 are disposed excessively biased forward in the top cover 20 and thus the laundry is accumulated first only in a front portion of the drum 60 to cause an imbalance.

As a result, it is preferable in the top load type washing machine like the laundry treating apparatus according to the present disclosure that the automatic detergent supply apparatus 1000 is not of the drawer type.

Therefore, the automatic detergent supply apparatus 1000 of the laundry treating apparatus according to the present disclosure may be mounted on top of the top cover 20 and exposed to the outside.

As a result, in the automatic detergent supply apparatus 1000 of the laundry treating apparatus according to the present disclosure, a degree of freedom may be secured as the direction in which the automatic detergent supply apparatus 1000 is mounted to or separated from the top cover 20 is less restricted than in the drawer type, and one or more of the height, the width, and the length may be increased sufficiently.

However, because it is difficult for the laundry treating apparatus 1000 to be accommodated and supported, the laundry treating apparatus according to the present disclosure may have a component to firmly fix the same. This will be described later.

FIG. 3 shows a structure of a top cover of a laundry treating apparatus according to the present disclosure.

A detergent supply 1000 of the laundry treating apparatus according to the present disclosure may be installed on the top cover 20.

The top cover 20 may be made of a plastic material and thus may be easily molded into a structure on which the detergent supply unit 1000 may be seated.

The water supply 70 may be installed on a rear surface of the top cover 20. The manual detergent supply apparatus 100 may be disposed at a rear lower portion of an opening 21 that extends through the top cover 20.

The manual detergent supply apparatus 100 may be constructed to be extendable forward from the top cover 20 and may receive powder detergent or liquid detergent. The manual detergent supply apparatus 100 may be in communication with the water supply 70 to receive water and discharge the introduced detergent downward.

Because the inlet of the tub 50 is defined under the opening 21, the detergent discharged from the manual detergent supply apparatus 100 may be delivered into the tub 50 as it is.

The manual detergent supply apparatus 100 may have a drawer 101 that is extended and retracted in the front and rear direction in the opening 21. As a result, the drawer 101 may be extended forward only when the detergent is added and may be accommodated in the top cover 20 at other times so as not to disturb the input of the laundry.

The automatic detergent supply apparatus 1000 may be disposed at a rear upper portion of the top cover 20. The automatic detergent supply apparatus 1000 may be disposed upwardly of the water supply 70 and may be disposed upwardly of the manual detergent supply apparatus 100.

Accordingly, the detergent discharged from the automatic detergent supply apparatus 1000 may be delivered to the water supply 70 or the manual detergent supply apparatus 100 and supplied to the tub 50.

The automatic detergent supply apparatus 1000 may include a storage 200 that stores the detergent supplied to the tub 50 therein, and a mounting portion 300 that fixes the storage 200 to the top of the top cover 20.

The storage 200 may be detachably disposed on the mounting portion 300. Accordingly, the storage 200 may be separated from the mounting portion 300 whenever necessary, making cleaning/maintenance easy.

Additionally, when the user supplies the detergent to the storage 200, the storage 200 may be removed from the mounting portion 300. As a result, the user may insert the detergent into the storage 200 without being restricted by location, and the top cover 20 and the like may be prevented from being contaminated during the process of inserting the detergent into the storage 200.

The storage 200 may include a plurality of storages to store different detergents therein. The plurality of storages 200 may be mounted on the mounting portion 300 along a width direction of the top cover 20.

The mounting portion 300 may be disposed in the width direction at a rear portion of the top cover 20. The mounting portion 300 may be formed integrally with the top cover 20 or may be mounted on the top cover 20 at the rear of the door 30.

The mounting portion 300 may be constructed such that the storage 200 is mounted thereon, and the storage 200 may be constructed such that a lower portion thereof is fixed to the mounting portion 300.

The storage 200 may be coupled to and separated from the mounting portion 300 in the state exposed to the outside of the top cover 20. As a result, a direction in which the storage 200 is coupled to or separated from the mounting portion 300 is not limited to a specific direction, so that the user may couple and separate the storage 200 to and from the mounting portion 300 without being greatly limited by the height of the cabinet 10.

An overall length of the storage 200 may be greater than a height or a thickness of the storage 200. As a result, while increasing a detergent storage capacity of the storage 200, a center of gravity of the storage 200 may be lowered and an area size of the door 30 or the opening 21 may be guaranteed.

A transfer portion that receives the detergent from the storage 200 and discharges the detergent into the tub 50 may be installed in the mounting portion 300. The transfer portion may include a detergent pump that discharges the detergent from the storage 200, and a detergent supply pipe that allows the detergent pump to be in communication with one or more of the water supply 70, the tub 50, and the manual detergent supply apparatus 100.

FIG. 4 shows an embodiment in which a storage is detached from a mounting portion.

Referring to (a) in FIG. 4, the storage 200 may include a first storage 200*a* that stores first detergent therein and is detachably coupled to the mounting portion 300, and a second storage 200*b* that is disposed separately from the first storage 200*a*, stores second detergent therein, and is detachably coupled to the mounting portion 300.

The first detergent may be laundry detergent necessary to remove the foreign substances from the laundry and the second detergent may be a bleach that bleaches the laundry, a softener that adjusts hardness and scent of fiber, or the like.

The first detergent and the second detergent may be in a liquid form and may be easily discharged into the mounting portion 300 by own weights thereof.

The manual detergent supply apparatus may store third detergent therein. The third detergent may be separate detergent different from the first detergent and the second detergent, or may be the same as the first detergent and the second detergent but in powder form.

In one example, the third detergent may be completely the same as one of the first detergent and the second detergent.

The first storage 200*a* and the second storage 200*b* may be formed in the same shape, may be disposed to be symmetrical to each other based on respective surfaces thereof facing each other, or may be formed in completely different shapes.

However, the first storage 200*a* and the second storage 200*b* may be formed in a structure that performs the same function and may be detachable from the mounting portion 300 in the same manner.

Therefore, hereinafter, structures, a coupling scheme, and a fixing scheme of the storage 200 and the mounting portion 300 will be described based on the second storage 200*b*. However, this is only to avoid redundant description, and the description may be applied to the first storage 200*a* in the same manner.

Referring to (b) in FIG. 4, the storage 200 may include a storage body 210 that provides a space to store the detergent therein.

The storage body 210 may be coupled and separated by sliding in the width direction of the top cover 20 on the mounting portion 300.

The storage body 210 does not need to be lifted from the mounting portion 300 when separated from the mounting portion 300 and does not need to be lifted upwardly of the mounting portion 300 when coupled to the mounting portion 300. Therefore, even when the storage body 210 is mounted on the top of the top cover 20 and mounted at the rear portion of the top cover 20, the user may easily attach and detach the storage body 210 to and from the mounting portion 300.

Additionally, the storage body 210 may be attached to or detached from the mounting portion 300 by being pressed or pulled from a side surface of the mounting portion 300. Accordingly, even in a state in which the door 30 has opened the opening 21, the user may attach and detach the storage body 210 to and from the mounting portion 300 from the rear of the door 30 in a slide scheme without being restricted.

Referring to (c) in FIG. 4, when the storage body 210 is removed by moving to the side surface of the mounting portion 300, the storage body 210 may then freely move not only laterally, but also upwardly, forwardly, rearwardly, and the like of the mounting portion 300.

In other words, even when an inner surface of the storage body 210 does not move to the outside of the mounting portion 300, the storage body 210 may be completely separated from the mounting portion 300. For example, when the storage body 210 and the mounting portion 300 in fluid communication with each other are separated from each other, the storage body 210 may be completely detachable from the mounting portion 300. Accordingly, the storage body 210 may continue to move to the side surface of the mounting portion 300 in the state supported by the mounting portion 300, and may be lifted in all directions except the downward direction from the mounting portion 300 and separated from the mounting portion 300.

As a result, even when a wall, another home appliance, or the like is disposed on an outer surface of the top cover 20 or an outer surface of the mounting portion 300 and a space for the storage body 210 to slide is not secured as much as a length of the storage body 210, the storage body 210 may be separated from the mounting portion 300.

When the storage body 210 is coupled to the mounting portion 300, the above-described method may be performed in a reverse order.

Referring to (d) in FIG. 4, the mounting portion 300 may include a communication portion 390 from which the storage body 210 is detachable. The storage body 210 may be disposed to be detachable from the communication portion 390 and may discharge the stored detergent into the communication portion 390.

The communication portion 390 may protrude from the mounting portion 300 in the width direction of the top cover 20. As a result, the storage body 210 may move in the width direction of the top cover 20 and be coupled to the communication portion 390.

The mounting portion 300 may be constructed such that the storage body 210 may move in the slide manner on top of the mounting portion 300 until the storage body 210 is completely separated from the mounting portion 300.

However, the storage body 210 may slide on the mounting portion 300 only when coupled to the communication portion 390. When the coupling of the storage body 210 and the communication portion 390 is released, the storage body 210 may be completely separated from the mounting portion 300 even when the storage body 210 does not slide.

As a result, the storage body 210 may be coupled to and separated from the mounting portion 300 by sliding in the width direction of the top cover 20 on top of the mounting portion 300. However, the storage body 210 may be supported on top of the mounting portion 300 and slide only when being fluidly coupled to and separated from the mounting portion 300. That is, in a state in which the fluid coupling of the storage body 210 and the mounting portion 300 is released, the storage body 210 may freely move on top of the mounting portion 300 without being restricted by a shape of the mounting portion 300.

The mounting portion 300 may include a mounting groove 310 that receives and supports at least a portion of a lower portion of the storage body 210.

A bottom surface of the storage body 210 may be supported on both side surfaces of the mounting groove 310 and guided to slide in the state of being accommodated in the mounting groove 310.

A restricting surface 320 that limits an inward movement or insertion of the storage body 210 may be disposed at one end of or inside the mounting groove 310.

The restricting surface 320 may support the storage body 210 and prevent the storage body 210 from vibrating inward.

The communication portion 390 may protrude outward from the restricting surface 320. The communication portion 390 may be disposed closer to a lower portion of the restricting surface 320 than to an upper portion.

In one example, when the storage 200 is seated on the mounting portion 300, it is necessary to prevent the storage 200 from being arbitrarily separated from the mounting portion 300. That is, the fact that the storage 200 slides along the mounting groove 310 and is easily detached from the mounting portion 300 means that the storage 200 may be easily separated from the mounting portion 300.

Because the laundry treating apparatus according to the present disclosure is constructed as the top load type washing machine, more vibration occurs in the mounting portion 300. Accordingly, the mounting portion 300 may be easily coupled to the storage 200, but separation and relative vibration may be difficult.

To this end, the mounting portion 300 may further include a bump 330 that prevents the storage body 210 from being withdrawn or sliding toward the outer surface when the storage body 210 is coupled to the communication portion 390 or is completely mounted on the mounting portion 300.

The bump 330 may protrude from the other end or an outer side of the mounting groove 310.

A detailed structure of the mounting portion 300 supporting and fixing the storage 200 will be described later.

FIG. 5 shows a structure of a mounting portion of a laundry treating apparatus according to the present disclosure.

The mounting portion 300 may include a mounting body 301 disposed on top of the top cover 20 in the width direction of the top cover 20 and supporting the storage 200, and the mounting groove 310 that is recessed from the mounting body 301 to receive and support the lower portion of the storage 200.

The mounting groove 310 may extend along the width direction in the mounting body 301 and guide the slide movement of the storage 200, and may accommodate a portion of the lower portion of the storage 200 and support or fix the storage 200 in the front and rear direction.

The mounting portion 300 may include the restricting surface 320 that extends stepwise upward from an inner side of the mounting groove 310 to prevent the storage 200 from moving further inward, and may include the communication portion 390 disposed on the restricting surface 320 and detachable from the storage 200. At least a portion of the communication portion 390 may be inserted into the storage body 210 to receive the detergent contained in the storage 200.

The communication portion 390 may protrude from the restricting surface 320 toward the other end or the outer side of the mounting groove 310. The restricting surface 320 may support a portion of the inner surface or the bottom surface of the storage body 210 to prevent the storage 200 from vibrating toward the inner side of the restricting surface 320.

The mounting portion 300 may include an accommodating rib 340 that is disposed at both sides based on the direction in which the storage 200 slides in the mounting groove 310, front and rear sides based on the top cover 20 and support the storage 200.

The accommodating rib 340 may extend from one end or the inner side of the mounting groove 310 toward the other end or the outer side, and may protrude upward from the mounting body 301 to accommodate at least a portion of the lower portion of the storage 200 therein.

The accommodating rib 340 may protrude upwardly of a bottom surface of the mounting groove 310 and may extend outward from an upper end of the restricting surface 320.

The mounting portion 300 may include the bump 330 that protrudes from the outer side or the other end of the mounting groove 310 to prevent the storage 200 from being withdrawn. The accommodating rib 340 may extend from the restricting surface 320 to the bump 330.

The accommodating rib 340 may support both sides of the storage 200 and may guide the storage 200 to slide to the inner side and the outer side of the mounting groove 310.

The bump 330 may be disposed to face the restricting surface 320 and may prevent the storage 200 from vibrating outwardly of the bump 330.

As a result, the mounting groove 310 may be defined by being recessed in the mounting body 301, but the accommodating rib 340, the bump 330, and the restricting surface 320 may protrude from the mounting body 301 to define the mounting groove 310 therein.

The mounting groove 310 may completely accommodate the lower portion of the storage 200 therein to fix and support the storage 200, and may accommodate some surfaces of the lower portion of the storage 200 to fix and support the storage 200.

A fastening portion 334 that detachably fixes the storage 200 may be disposed on an outer surface of the bump 330. The fastening portion 334 may be defined as a groove recessed from the outer surface of the bump 330 and may be detachably coupled to a hook disposed on the storage 200.

The mounting portion 300 may fix the lower portion of the storage when the storage is mounted in the mounting groove 310.

When the storage 200 is coupled to the communication portion 390, the restricting surface 320 and the bump 330 may fix the storage 200 to prevent the storage 200 from vibrating or moving further in the width direction.

When the storage 200 is coupled to the communication portion 390, the accommodating rib 340 may fix the storage 200 to prevent the storage 200 from vibrating or moving in the front and rear direction.

The mounting portion 300 may accommodate or support four surfaces of the lower portion of the storage 200 to prevent the storage 200 from being arbitrarily separated from the mounting portion 300.

When the storage 200 is coupled to the communication portion 390, the fastening portion 334 defined in the bump 330 may be detachably coupled to the storage 200 to additionally fix the storage 200.

In one example, the mounting portion 300 may additionally support the lower portion of the storage 200 via a side step 350 disposed outside the accommodating rib 340, an inner support surface 380 disposed inwardly of the restricting surface 320, and an outer step 360 and an outer support surface 370 disposed outwardly of the bump 330.

As a result, when the storage 200 is seated, the mounting portion 300 may fix the storage 200 to prevent the storage 200 from being separated arbitrarily, and prevent the storage 200 from vibrating in a direction of one of the four surfaces.

FIG. 6 shows a cross-sectional view of the mounting portion.

In addition to the detachable coupling and support structures, the mounting portion 300 may be formed in a shape to easily mount the storage 200 thereon while preventing the withdrawal of the storage 200.

A depth H1 of the mounting groove 310 in a portion adjacent to the communication portion 390 may be greater than a depth H2 of the mounting groove 310 in a portion adjacent to the bump 330.

Additionally, the mounting portion 300 may be constructed such that the mounting groove 310 is inclined in the width direction of the top cover.

The mounting groove 310 may have an inclination that decreases in a vertical level from the bump 330 toward the restricting surface 320. The mounting groove 310 may be defined such that the vertical level thereof decreases from the other end or the outer side to the one end or the inner side, so that the storage 200 seated in the mounting groove 310 may be induced to slide toward the communication portion 390 by gravity.

Additionally, when the storage 200 is seated in the mounting groove 310, the gravity may act in the direction toward the communication portion 390, thereby preventing the storage 200 from sliding in the mounting groove 310 in an opposite direction.

The lower portion of the storage 200 may have an inclination corresponding to the inclination of the mounting groove 310, so that the center of gravity may be further biased toward the restricting surface 320.

As a result, even when the vibration in the width direction occurs in the storage 200, the restricting surface 320 or the communication portion 390 may support a load of the storage 200 and prevent the storage 200 from deviating to the outside of the mounting groove 310.

In addition, the bump 330 may have an inner surface 331 that supports a lower outer surface of the storage 200, so that the storage 200 may be prevented from deviating to the outside of the bump 330.

In addition, the bump 330 may have the fastening portion 334 in an outer surface 333 to fix the storage 200, thereby preventing the storage 200 from deviating to the outside.

An exposed surface 332 extending the inner surface and the outer surface of the bump 330 may be disposed parallel to an upper end of the restricting surface 320. The exposed surface 332 may support the lower portion of the storage 200.

FIG. 7 shows a structure of a storage of a laundry treating apparatus according to the present disclosure.

The storage 200 may include the storage body 210 that receives and stores the detergent therein, and a plate 220 that is disposed at the bottom of the storage body 210 and is able to be mounted on the mounting groove 310.

The plate 220 may form the lower portion of the storage body 200, and the plate 220 may be formed integrally with the storage body 210 or may be coupled to the lower portion of the storage body 210.

The plate 220 may be detachable from the mounting portion 300 and may be fixed to the mounting portion 300. The storage body 210 may be stably fixed to the mounting portion 300 by the plate 220.

The plate 220 may include a discharge portion 230 that is detachably coupled to the communication portion 390 and discharges the detergent at one side or at the bottom.

The discharge portion 230 may be disposed closer to one end or an inner side of the plate 220 than to the other end or an outer side.

A check valve that discharges the detergent of the storage body 210 only when being coupled with the communication portion 390 may be installed on the discharge portion 230.

The plate 220 may include a bottom surface 222 that forms a bottom surface of the storage body 210 and allows the detergent to flow to the discharge portion 230.

The bottom surface 222 may have an inclination that decreases in vertical level from the other end or the outer side of the storage body 210 to the one end or the inner side. That is, the bottom surface 222 may have the inclination that decreases in the vertical level toward the discharge portion 230 to induce the detergent of the storage body 210 to be discharged into the discharge portion 230 and also prevent the detergent from remaining inside the storage body 210.

The storage body 210 and the plate 220 may all be accommodated and supported in the mounting groove 310.

However, when the entire storage 200 is accommodated in the mounting groove 310, it is easy to support and fix the storage 200 in the mounting groove 310, but it may be too difficult to withdraw the storage 200.

Accordingly, only a portion of the storage 200 may be accommodated in the mounting groove 310 and the remaining portion may be disposed outside the mounting groove 310 to facilitate the separation of the storage 200 from the mounting portion 300.

To this end, the plate 220 and the storage body 210 may have a length greater than a length in the width direction of the mounting groove 310, so that respective portions thereof may be disposed outside the mounting groove 310.

The plate 220 may include a coupling surface 223 extending from the bottom surface 222 to the other end or the outer side. The coupling surface 223 may be disposed outside the mounting groove 310 and may be supported on an outer surface of the bump 330.

In the storage 200, the discharge portion 230 is supported by the communication portion 390, and the coupling surface 223 is supported by the bump 330, so that the storage 200 may be prevented from further moving to the inner side of the mounting groove 310 and vibrating.

In one example, a fixing portion 400 may be further included such that the storage 200 is supported on the outer support surface 370 when the storage 200 is mounted on the mounting portion 300.

The fixing portion 400 may protrude downward from the coupling surface 223 and be supported in a hook insertion groove 371 defined in the outer support surface 370. The hook insertion groove 371 may be defined as a portion of the outer support surface 370 is recessed.

The coupling surface 223 may include a hook insertion hole 224 defined by perforating a portion of the coupling surface 223. The fixing portion 400 may pass through the hook insertion hole 224 and be inserted into the hook insertion groove 371.

As a result, the fixing portion 400 of the storage 200 may be fixed to the mounting portion 300, thereby preventing the storage 200 from being separated from the mounting portion 300.

Additionally, the plate 220 may further include one or more of a support protrusion 227 supported inside the restricting surface 320 and a coupling portion 250 that is disposed on the coupling surface 223 and is detachably fixed to the fastening portion 334 disposed on the outer surface 333 of the bump 330.

The support protrusion 227 may protrude from the plate 220 at a length to prevent the discharge portion 230 from being in contact with the bottom surface of the mounting groove 310.

Additionally, the support protrusion 227 may be supported on an inner surface of the restricting surface 320.

The coupling portion 250 may be formed in a shape of a hook that is detachably coupled to the fastening portion 334 defined in the bump 330.

As a result, the support protrusion 227 may prevent the storage 200 from excessively moving into the mounting groove 310 or vibrating. In addition, the coupling portion 250 may prevent the storage 200 from moving inward in the mounting groove 310 or vibrating and may prevent the storage 200 from moving outward of the mounting groove 310 or vibrating at a certain level via a force of coupling with the fastening portion 334.

As a result, the storage 200 may further expand a volume of the storage body 210 by enlarging the storage body 210 to have a length greater than that of the mounting groove 310, and at the same time, a portion of the lower portion of the storage body 210 may be stably accommodated in, supported by, and fixed to the mounting groove 310 via the plate 220. In other words, the storage 200 may be supported on the inner support surface 380 disposed inwardly of the mounting groove 310, and may extend further outward than the mounting groove 310 to further increase the detergent storage capacity. Additionally, the storage 200 may be stably seated in and fixed to the mounting groove 310 via the component that protrudes downward from the plate 220.

In one example, the storage 200 may further include a support rib 240 that extends downward from both side surfaces based on the slide movement direction of the storage body 210 and shields a portion of the plate 220.

The support rib 240 may be supported by an outer surface of the accommodating rib 340, which will be described later, and may accommodate the mounting groove 310 and the entire accommodating rib 340.

The support rib 240 may fix the storage 200 in the front and rear direction of the top cover 20 and prevent the storage 200 from vibrating or moving in the front and rear direction of the top cover 20.

FIG. 8 shows a width direction fixing structure of an automatic detergent supply apparatus in a laundry treating apparatus according to the present disclosure (370 and 371 added).

When the storage 200 is seated on the mounting portion 300, the support protrusion 227 or an inner surface of the storage 200 may be supported on the restricting surface 320.

Alternatively, the support protrusion 227 of the storage 200 may be supported on the restricting surface 320, and the discharge portion 230 may be supported on the communication portion 390.

Additionally, when the storage 200 is seated on the mounting portion 300, at least a portion of the fixing portion 400 may be inserted into the hook insertion groove 371.

In the storage 200, the support protrusion 227 or the discharge portion 230 may be supported on the restricting surface 320 or in the communication portion 390, and the fixing portion 400 may be supported on the outside of the bump 330.

As a result, a state of the storage 200 may become a state in which the lower portion thereof is forcibly fitted by the restricting surface 320 and the bump 330, and may be fixed in the width direction in the mounting groove 310.

Therefore, the laundry treating apparatus according to the present disclosure may stably fix the storage 200 in the width direction even without the housing for accommodating the storage 200 therein.

In one example, the fixing portion 400 may protrude from the storage 200, but may be attached to and detached from the storage 200. The fixing portion 400 may be attached to and detached from the storage 200 via the hook insertion hole 224.

The fixing portion 400 may be inserted into the storage 200. Accordingly, the fixing portion 400 may be selectively fixed inside the hook insertion groove 371.

The storage 200 may further include a push portion 260 that presses the fixing portion 400 and raises the fixing portion 400 to separate the same from the outer support surface 370.

The push portion 260 may be exposed to the outside of the storage 200 to be pressed inward, and may selectively ascend and descend the fixing portion 400.

Accordingly, the user may separate the storage 200 from the outer support surface 370 by pressing the push portion 260. As a result, even when the storage 200 is securely fixed to the mounting portion 300 in the width direction, the storage 200 may be easily separated from the mounting portion 300 when the push portion 260 is pressed.

FIG. 9 shows a cross-sectional view of the storage mounted on the mounting portion.

The storage body 210 may include an accommodating body 211 that accommodates the detergent therein, and an installation portion 212 that installs the fixing portion 400.

Because the fixing portion 400 is constructed to be able to reciprocate in the storage body 210, the fixing portion 400 needs to be separated from the detergent accommodated in the storage body 210.

To this end, the storage body 210 may have the installation portion 212 that provides a space where the fixing portion 400 is installed. The accommodating body 211 may be disposed inside the installation portion 212, and a partition plate 225 may be disposed in a height direction between the accommodating body 211 and the installation portion 212.

The partition plate 225 may be disposed inside the storage body 210 to partition the installation portion 212 and the accommodating body 211 from each other.

Not only the fixing portion 400, but also the coupling portion 250 coupled to the bump 330 may be installed in the installation portion 212.

The plate 220 may form a bottom surface of the accommodating body 211 and may be formed as an inclined surface to discharge the detergent into the discharge portion 230.

That is, the plate 220 may have an inclination with a distance from a top surface of the storage body 210 increasing in a direction toward the discharge portion 230. A bottom surface of the plate 220 may have an inclination corresponding to an inclination of the mounting groove 310.

As a result, the storage 200 may be constructed such that a height thereof increases from an outer side or the installation portion 212 toward the discharge portion 230.

The communication portion 390 may be detachably coupled to the discharge portion 230.

In one example, the accommodating body 211 may extend further rearward than the discharge portion 230 and be supported on the inner support surface 380. Accordingly, the accommodating body 211 may be constructed such that most of the accommodating body 211 except for the portion of the lower portion is exposed to the outside of the mounting groove 310. As a result, the storage 200 may secure the detergent storage capacity without being limited by a volume of the mounting groove 310.

Additionally, the installation portion 212 may be disposed to extend beyond the bump 330 and extend further outward than the outer surface of the bump 330.

Accordingly, the storage 200 may have the coupling portion 250 not only on an inner surface of the bump 330 but also on the outside of the bump 330. The storage 200 may support both the inner and outer surfaces of the bump 330 and be fixed to the mounting portion 300.

FIG. 10 shows a structure in which the storage is fixed to the mounting portion in a front and rear direction.

Referring to (a) in FIG. 10, the mounting portion 300 may have the accommodating rib 340 protruding in the front and rear direction of the mounting groove 310, thereby preventing the storage 200 from vibrating or deviating forward or rearward.

The accommodating rib 340 may accommodate the bottom surface of the plate 220 therein.

The mounting portion 300 may further include the side step 350 disposed between an outer side of the accommodating rib 340 and the mounting body 301. The side step 350 may extend from the mounting body 301 along an extension direction of the accommodating rib 340.

The side step 350 may serve as a rail on which the storage 200 is supported and slides.

In other words, the storage 200 may be guided to slide while seated on the side step 350.

The storage 200 may have the bottom surface of the plate 220 or the like accommodated and supported inside the accommodating rib 340, and at the same time, supported on the side step 350 to support the outer surface of the accommodating rib 340.

That is, the storage 200 may be formed in a shape in which the bottom surface thereof supports both the inner and outer surfaces of the accommodating rib 340 and grips both surfaces of the accommodating rib 340. As a result, the storage 200 is fixed in the front and rear direction on the top cover 20, thereby preventing the storage 200 from moving or vibrating forward and rearward.

In one example, the mounting groove 310 may be defined to have a greater depth at a side facing the rear surface than at a side facing the opening 21. That is, the mounting groove 310 may have a depth L1 at a side adjacent to a portion of the accommodating rib 340 located at the rear surface greater than a depth L2 at a side adjacent to a portion of the accommodating rib 340 located at the front surface.

The mounting groove 310 may have the inclination that becomes deeper rearwards. Accordingly, even when the detergent stored in the storage 200 leaves the mounting groove 310 because of severe vibration, the detergent may be prevented from falling into the opening 21.

In addition, because the rear surface of the mounting groove 310 will correspond to a wall surface where a water pipe and the like are typically disposed, the storage 200 may be induced to be seated in the mounting groove 310 again by the wall surface.

Referring to (b) in FIG. 10, the storage 200 may have the support rib 240 protruding downward from both side surfaces of the storage body 210 supported on the outer surface of the accommodating rib 340.

The support rib 240 may extend downwardly of the plate 220.

The support rib 240 may accommodate both surfaces of the accommodating rib 340 and be supported on the outer surface of the accommodating rib 240.

Accordingly, the storage 200 may be firmly fixed in the front and rear direction because the plate 220 is accommodated in the mounting groove 310 and the support rib 240 accommodates the accommodating rib 340. The storage 200 may be blocked from vibrating in the front and rear direction.

The support rib 240 may extend further downward from the discharge portion 230 in a direction toward the bump 330. The support rib 240 may accommodate both surfaces of the bump 330 therein.

An inclination of a bottom surface of the support rib 240 may be formed opposite to the inclination of the mounting groove 310 and the inclination of the bottom surface of the plate 220.

Correspondingly, the side step 350 may also be formed to have a height decreasing as it extends from the inner side to the outer side of the accommodating rib 340.

Accordingly, when the support rib 240 is coupled from the outside to the inside, it is guided to engage accurately with the side step 350, so that the storage 200 may be closely mounted on the mounting portion 300 while sliding.

Additionally, when the storage 200 moves to the outside of the mounting portion 300, the support rib 240 may be induced to be easily separated from the side step 350.

As a result, the storage 200 may be fixed in all four surface directions because of the support rib 240, the fixing portion 400, the coupling portion 250, the support protrusion 227, and the discharge portion 230.

FIG. 11 shows an exploded perspective view of the storage body of the storage.

The storage body 210 may be formed longer in the width direction than in the front and rear direction and in the height direction, based on the top cover 20.

An inner surface 2113 of the storage body 210 may be oriented in a vertical direction or a direction close to the vertical direction so as to be in close contact with another storage body 210 facing the same, and an outer surface 2114 may have an inclination to be upwardly convex in a direction from a top surface to a bottom surface, thereby preventing water from accumulating on a top surface 2111 and preventing the laundry from getting caught on the outer surface 2114 or the like of the storage body 210 and damaging.

The top surface 2111 of the storage body 210 may have an input hole 2117 into which the detergent may be input.

In the storage body 210, the detergent may be input via the input hole 2117 and discharged into the discharge portion 230 disposed at the bottom. As a result, the detergent may be prevented from remaining in the storage body 210.

The top surface 2111 of the storage body 210 may have a door hinge 2116 to which a cover door 214 that opens and closes the input hole 2117 is pivotably coupled. The cover door 214 may be formed in a plate shape that may serve as the top surface of the storage body 210 when it covers the input hole 2117, and may include a hinge coupling portion pivotably coupled to the door hinge 2116 at one end.

The input hole 2117 may be defined with a measurer that may measure an amount of detergent contained in the storage body 210 protruding inward.

Both side surfaces 2112 of the storage body 210, as surfaces exposed at front and rear sides of the top cover 20, may be constructed to be gripped by the user.

In one example, an outer surface 254 may be additionally coupled to the outer surface 2114 of the storage body 210.

The outer surface 254 may serve to fix the above-described coupling portion 250 to the storage body 210.

In one example, the plate 220 that forms the bottom surface of the storage body 210 to prevent the detergent from leaking out of the storage body 210 may be disposed under the storage body 210.

A buffer member 270 that prevents friction with the mounting portion 300 and vibration impact may be coupled under the plate 220, and the buffer member 270 may be coupled to each lower edge of the plate 220.

The plate 220 may have the discharge portion 230 that may discharge an appropriate amount of detergent introduced into the storage body 210 to the outside. The discharge portion 230 may be formed in a shape of a check valve and may discharge the detergent to the outside only when coupled to the communication portion 390, and may prevent the detergent or water from flowing back into the storage body 210.

The storage body 210 may include the support rib 240 that protrude further from each corner. The support rib 240 may include a lower rib 241 that supports the outer surface of the accommodating rib 340 described above and fixes the storage body 210 in the front and rear direction, an inner surface rib 242 protruding from the inner surface 2113 of the storage body 210, and an extension rib 243 disposed under the inner surface of the storage body 210 and extending the lower rib 241 on both sides.

The lower rib 241 may guide the storage body 210 to slide on the mounting portion 300 while also serving to fix the storage body 210 to the mounting portion 300.

In addition, the inner surface rib 242 may serve to reinforce durability of the storage body 210 in preparation for collision with another adjacent storage body 210.

Additionally, the extension rib 243 may serve to reinforce durability of the lower rib 241.

The fixing portion 400 may include a fixing body 410 that is accommodated in the installation portion 212 and protrudes downwardly of the plate 220, and a restoring portion 420 that pushes the fixing body 410 out of the plate 220.

The push portion 260 that is disposed on one of both side surfaces 2112 of the storage body 210 to move or ascend and descend the fixing portion 400 may be installed.

The push portion 260 may move the fixing portion 400 by pressing one side of the fixing portion 400.

When the push portion 260 is pressed, the fixing portion 400 may move inwardly of the storage body 210 and be spaced apart from the outer support surface 370. An operating process of the fixing portion 400 will be described later.

FIG. 12 shows an exploded perspective view of the plate of the storage.

The plate 220 coupled to the lower portion of the storage body 210 may include a plate body 221 that forms the bottom surface of the storage body 210, and the bottom surface 222 that is disposed inside the plate body 221 and disposed inside the mounting groove 310.

The bottom surface 222 may include a guide groove 2221 that is recessed in the plate body 221 to guide the detergent to the discharge portion 230, and an installation groove 2222 that is further recessed in the guide groove 2221 to define a space in which the discharge portion 230 is installed.

The installation groove 2222 may have a discharge hole that extends through the installation groove 2222 toward the inner surface of the storage body 210 such that the discharge portion 230 is inserted and installed therein or that is coupled with the communication portion 390 to discharge the detergent. The discharge hole may be defined in a direction corresponding to the slide movement direction of the storage 200 in the plate 220.

A sealing rib that is coupled with the inner surface, a partition surface, and a lower end of the side surface of the storage body 210 to prevent the leakage of the detergent may be formed on an outer peripheral surface of the guide groove 2221.

The accommodating body 211 may be seated inside or at one side of the bottom surface. The bottom surface 222 may have a width or an area size corresponding to that of the mounting groove 310, and at least a portion of the bottom surface 222 may be accommodated and seated within the accommodating rib 340.

The coupling surface 223 may be disposed to extend from the outer side or the other side of the bottom surface 222.

The coupling surface 223 may have an inclination such that a height thereof decreases in an outward direction from the bottom surface 222, and may have the inclination opposite to that of the bottom surface 222. Accordingly, the coupling surface 223 may be disposed such that an inner surface thereof faces the outer surface of the bump 330.

The coupling portion 250 described above may be installed on the coupling surface 223, and a detachable hook 2232 that detachably fixes the coupling portion 250 may be disposed.

The coupling surface 223 may be disposed outwardly of the accommodating body 211.

The coupling surface 223 may include the hook insertion hole 224 through which the fixing portion 400 is inserted and withdrawn. The hook insertion hole 224 may be defined such that the fixing portion 400 extends through the plate 220 and reciprocates in the vertical direction.

The hook insertion hole 224 may be defined by perforating the portion of the coupling surface 223.

The hook insertion hole 224 may further include guide ribs 2241 disposed on both sides of the hook insertion hole 224 to guide the fixing portion 400 to move only in the height direction. Accordingly, the fixing portion 400 may only ascend and descend in the height direction via the hook insertion hole 224 when the push portion 260 is pressed.

FIG. 13 shows a structure in which the fixing portion is installed in the storage.

The fixing portion 400 may be accommodated inside the storage body 210 and coupled to the push portion 260.

The fixing portion 400 may include the fixing body 410 coupled to the push portion 260, a locking hook 440 disposed downwardly of the fixing body 410 such that at least a portion thereof is selectively inserted into the mounting portion 300, and an elastic portion 430 disposed to connect the body 410 with the locking hook 440.

A connecting body 420 may be disposed under the fixing body 410. As a result, the connecting body 420 may be supported and fixed outwardly of the bump 330, and may guide the fixing portion 400 to move in the front and rear direction along an edge of the bump 330 when the push portion 260 is pressed forward.

The locking hook 440 may be disposed rearward of the fixing body 410. That is, the locking hook 440 may be disposed close to the push portion 260. Accordingly, when the push portion 260 is pressed forward, the fixing body 410 may also move forward and the elastic portion 430 may be compressed to guide the locking hook 440 to be withdrawn from the hook insertion groove 371.

The elastic portion 430 may connect the connecting body 420 with the locking hook 440 to pull the locking hook 440 to the outside of the plate 220.

The push portion 260 may be coupled to the side surface of the storage body 210 and pressurized. Additionally, the push portion 260 may be disposed at the other side or the outer side of the storage body 210.

Because the storage 200 is attached to and detached from the mounting portion 300 in the width direction, it requires less force for the user to grip the outer side of the storage body 210 to separate the storage 200.

A push installation portion 213 on which the push portion 260 may be installed may be disposed on the side surface of the storage body 210. Likewise, the push installation portion 213 may be disposed at the other side or the outer side of the storage body 210.

The push installation portion 213 may include a seating groove 2131 that extends through the side surface of the storage body 210 or is recessed in the side surface to accommodate the push portion 260, a support 2132 that is disposed inside the seating groove 2131 to support one end of the push portion 260, and an insertion hole 2133 defined at one side of the support 2132 to completely extend through the storage body 210 such that the other end of the push portion 260 may be inserted thereinto.

The seating groove 2131 may be defined in a shape the same as an external shape of the push portion 260 to accommodate the entire push portion 260 therein, and the support 2132 may be recessed to correspond to a thickness of the push portion 260 such that the push portion 260 does not protrude excessively from the storage body 210.

The support 2132 may serve as a center of a lever or a center of a seesaw. Accordingly, when the push portion 260 is pressed, only the other end thereof may be inserted into the insertion hole 2133, and when the external force disappears, as the locking hook 440 and the fixing body 410 are returned to original locations thereof by the force of the elastic portion 430, the push portion 260 may be pushed out of the insertion hole 2133 and may be disposed at a correct location.

FIG. 14 shows a detailed structural embodiment of the fixing portion and the push portion.

(a) in FIG. 14 is a side view when the fixing portion 400 and the push portion 260 are separated from each other, and (b) in FIG. 14 is a cross-sectional view when the fixing portion 400 and the push portion 260 are coupled to each other.

The push portion 260 may include a push body 261 disposed at one side of the storage body 210 and exposed to the outside, an extension body 262 extending from the push body 261 inwardly of the storage body 210, and a coupling body 263 that extends from the extension body 262 toward the fixing portion 400 and is coupled to the fixing portion 400.

The push body 261 may be pressed into the storage body 210 by the external force, and the coupling body 263 may further include a coupling groove 2631 into which a coupling protrusion 412 of the fixing body 410, which will be described later, is inserted and fastened.

The fixing body 410 may be accommodated inside the storage body 210 and coupled to the push portion 260. As the push portion 260 is pressurized, the fixing body 410 may reciprocate in the front and rear direction. The fixing body 410 may be formed in a rectangular parallelepiped shape.

The fixing body 410 may include a body-to-be-inserted 411 that is inserted into the coupling body 263 and coupled to the push portion 260.

The body-to-be-inserted 411 may have the coupling protrusion 412 that is inserted into and fastened to the coupling groove 2631. The coupling protrusion 412 may be formed as a protrusion that protrudes from upper and lower portions of the body-to-be-inserted 411 and is coupled to the coupling groove 2631.

Accordingly, when the push portion 260 and the fixing portion 400 are coupled to each other as shown in (b) in FIG. 14, the body-to-be-inserted 411 may be inserted into the coupling body 263, and the coupling protrusion 412 may be inserted into the coupling groove 2631. As a result, the push portion 260 and the fixing portion 400 are firmly fixed, so that the fixing portion 400 may move as the push portion 260 is pressed.

The fixing portion 400 may include the connecting body 420 extending downward from the fixing body 410. The connecting body 420 may be inclined downward toward the mounting portion 300 such that a side surface thereof is supported by the bump 330. Accordingly, when the push portion 260 slides in the front and rear direction, the connecting body 420 is guided to move in the front and rear direction along the bump 330, thereby preventing the fixing portion 400 from deviating to the outside of the bump 330.

The fixing portion 400 may include the elastic portion 430 disposed to connect the connecting body 420 with the locking hook 440. Because the elastic portion 430 has an elastic force, when the push portion 260 is pressed, the elastic portion 430 may be compressed and pull the locking hook 440 to the outside of the plate 220.

The fixing portion 400 may include the locking hook 440 disposed downwardly of the fixing body 410 such that at least a portion thereof is selectively inserted into the mounting portion 300.

The locking hook 440 may include an elastic portion seating portion 441 on which the elastic portion 430 is seated, and a movable surface 442 slidable in the front and rear direction on the mounting portion 300.

The elastic portion seating portion 441 may be disposed on a top surface of the locking hook 440. Accordingly, the elastic portion 430 may pull the locking hook 440 in the height direction to separate the same from the mounting portion 300.

The movable surface 442 may be disposed at a lower portion of the locking hook 440 and at a corner of the elastic portion 430, so that when the elastic portion 430 is compressed, the hook insertion groove 371 may automatically slide and move by the movable surface 442. As a result, the fixing portion 400 may be prevented from moving in the width direction and may be guided to move only in the front and rear direction.

FIG. 15 shows an operating scheme of the fixing portion.

Referring to (a) in FIG. 15, when the external force pressing the push body 261 is released, the elastic portion 430 may begin to expand and may move the fixing body 410 downward. The elastic portion 430 pushes the locking hook 440 in a direction toward the push body 261 while moving downward.

In other words, when the push body 261 is in a normal state of not being pressed, the locking hook 440 may be inserted into the hook insertion groove 371 and the storage 200 may be fixed to the mounting portion 300.

As a result, even when vibration in the width direction or front and rear direction occurs in the storage 200 or a force to pull the storage 200 to the outside of the mounting body 301 is applied, the storage 200 may not move outward and be fixed to mounting portion 300.

The storage 200 must not only be able to be fixed to the mounting portion 300, but also be able to be detached from the mounting portion 300 when the user desires. The user may separate the storage 200 from the mounting portion 300 by pressing the push body 261 of the push portion 260.

Referring to (b) in FIG. 15, when the push body 261 is pressed, the fixing body 410 and the connecting body 420 move in the direction in which the push body 261 is pressed, and the elastic portion 430 connected to the connecting body 420 is compressed and pulls the locking hook 440 to be withdrawn from the hook insertion groove 371. As a result, the storage 200 may be separated from the mounting portion 300.

Because the mounting portion 300 is located at the rear side of the top cover 20, the user may press the push portion 260 forward. The push portion 260 may be disposed on one surface of the storage body 210 to be pressed in the front and rear direction of the top cover 20.

When the push portion 260 is pressed forward, the fixing body 410 moves forward and the locking hook 440 moves upward. As a result, the fixing portion 400 may be withdrawn from the mounting portion 300 in the height direction when the push portion 260 is pressed. Accordingly, the direction in which the push portion 260 is pressed and the direction in which the fixing portion 400 moves may be perpendicular to each other.

Accordingly, the user may press the push portion 260 from the rear side of the top cover 20 to easily separate the storage 200 from the mounting portion 300 in the sliding manner in the width and height directions of the top cover 20.

The hook insertion hole 224 of the storage 200 may further include the guide ribs 2241 disposed on both sides of the hook insertion hole 224 to guide the locking hook 440 to move only in the height direction. Accordingly, when the push portion 260 is pressed or the external force pressing the push portion 260 is released, the locking hook 440 may be prevented from moving in the width direction and may be guided to move only in the front and rear direction and the height direction.

The fixing portion 400 may include a prevention rib 450 protruding from one side surface thereof. The prevention rib 450 may include a first prevention rib 451 that protrudes from one side surface of the connecting body 420 and a second prevention rib 452 that protrudes from one side surface of the fixing body 410.

The fixing body 410 or the connecting body 420 may slide along the prevention rib 450 to guide the fixing portion 400 to move in the front and rear direction and to prevent the fixing portion 400 from deviating inwardly or outwardly of the bump 330.

FIG. 16 shows a process in which the storage is separated from the mounting portion.

Referring to (a) in FIG. 16, the storage 200 is in the state of being mounted on the mounting portion 300.

The fixing portion 400 may protrude downward from the plate 220 through the hook insertion hole 224 and be supported on the outer support surface 370. In other words, as the locking hook 440 is inserted into the hook insertion groove 371, the storage 200 is fixed to the mounting portion 300.

As a result, even when a portion of the bottom surface 222 in the storage 200 is accommodated in the mounting groove 310 and the remaining portion is disposed outside the mounting groove 310 beyond the bump 330, the storage 200 may be maintained is in the state of being accommodated in the mounting groove 310.

In addition, even when the vibration in the width direction or in the front and rear direction occurs in the storage 200 or a force of pulling the storage 200 to the outside of the mounting body 301 is applied, the storage 200 may not move outward and may be fixed to the mounting portion 300.

Referring to (b) in FIG. 16, when the push portion 260 is pressed, the fixing portion 400 may ascend upward. Specifically, when the push portion 260 is pressed forward, the fixing body 410 and the connecting body 420 may also move forward. As a result, the elastic portion 430 may be compressed and the locking hook 440 may ascend upward to be withdrawn from the hook insertion groove 371.

When the locking hook 440 ascends, any component of the storage 200 is not restricted by the mounting portion 300.

In one example, when the vibration is not transmitted to the storage 200 or there is no outward pulling force, because the discharge portion 230 and the communication portion 390 are coupled to each other, the storage 200 may be maintained in the state of being mounted on the mounting portion 300.

When the external force applied to the push portion 260 is released again and the fixing body 410 and the connecting body 420 move rearward and thus the elastic portion 430 expands and the locking hook 440 descends, the storage 200 may be fixed to the mounting portion 300.

Accordingly, even when the automatic detergent supply apparatus 1000 is not accommodated in a drawer or the like, the automatic detergent supply apparatus 1000 may be stably supported because of the structure of the fixing portion 400. Additionally, because of the structure in which the fixing portion 400 is selectively withdrawn from the mounting portion 300, the automatic detergent supply apparatus 1000 may be easily separated from the top cover 20 when the user wishes to separate the same.

What is claimed is:

1. A laundry treating apparatus comprising:

a cabinet;

a tub located inside the cabinet, the tub being configured to store water therein;

a drum rotatably located in the tub, the drum being configured to accommodate laundry therein;

a top cover coupled to an upper portion of the cabinet, the top cover having an inlet defined therein to allow the laundry to be inserted therethrough;

a door pivotably coupled to the top cover to open and close the inlet;

a mounting portion located on the top cover, the mounting portion being located rearward of the door;

a storage to store detergent therein, the storage being detachably mounted on the mounting portion; and a fixing portion at least partially accommodated inside the storage, the fixing portion being configured to be inserted into and withdrawn from the storage to be selectively inserted into the mounting portion to fix the storage to the mounting portion.

2. The laundry treating apparatus of claim 1, wherein the storage is detachable from the mounting portion by movement in a width direction of the top cover.

3. The laundry treating apparatus of claim 2, wherein the mounting portion includes:

a mounting body located on the top cover and rearward of the door; and a restricting surface located at an inner side or one end of the mounting body, the restricting surface being configured to support the storage.

4. The laundry treating apparatus of claim 1, wherein the storage includes:

a storage body detachably mounted to the mounting portion, the storage body being configured to store the detergent therein; and a push portion located on the storage body, the push portion being at least partially exposed to outside of the storage body, the push portion being configured such that a pressing direction of the push portion and a moving direction of the fixing portion are perpendicular to each other.

5. The laundry treating apparatus of claim 4, wherein the push portion is located on one surface of the storage body so that the pressing direction is in a front and rear direction of the top cover, and wherein the fixing portion is configured to be withdrawn from the mounting portion in a height direction of the storage body when the push portion is pressed.

6. The laundry treating apparatus of claim 4, wherein the fixing portion includes:

a fixing body coupled to the push portion;

a locking hook protruding downwardly from the fixing body to be selectively inserted into the mounting portion; and an elastic portion connecting the fixing body to the locking hook.

7. The laundry treating apparatus of claim 6, wherein the locking hook extends towards the push portion.

8. The laundry treating apparatus of claim 6, wherein the storage further includes:

a plate located under the storage body, the plate being configured to be detachably seated on the mounting portion;

a hook insertion hole defined in the plate, the hook insertion hole being configured to receive the locking hook therein; and guide ribs located on opposite sides of the hook insertion hole to guide the locking hook to move only in a height direction.

9. The laundry treating apparatus of claim 6, wherein the fixing portion further includes ribs located at opposite sides of the fixing body to guide the push portion or the fixing body to move only in a front and rear direction.

10. The laundry treating apparatus of claim 6, wherein the locking hook includes a movable surface configured to be slidable in a front and rear direction on the mounting portion.

11. The laundry treating apparatus of claim 4, wherein the storage further includes a discharge portion located at a first side of the storage body, the discharge portion configured to be in communication with and detachably coupled to the mounting portion, and wherein the push portion is at a second side of the storage body different than the first side.

12. The laundry treating apparatus of claim 11, wherein the first side is an inner side of the storage body.

13. The laundry treating apparatus of claim 4, wherein the mounting portion further includes an insertion groove at a portion of a top surface of the mounting portion facing the storage body, and wherein the fixing portion is configured to be inserted into the insertion groove.

14. The laundry treating apparatus of claim 13, wherein the mounting portion further includes:

a mounting groove configured to support a lower portion of the storage body;

a communication portion disposed at a first side of the mounting groove, the communication portion being detachably coupled to the storage body to receive the detergent stored in the storage body;

a bump protruding at a second side of the mounting groove different than the first side; and an outer support surface extending outwardly of the bump, the outer support surface being configured to support the storage, and wherein the insertion groove is located at the second side of the mounting groove.

15. The laundry treating apparatus of claim 14, wherein the first side is an inner side of the mounting groove, and wherein the second side is an outer side of the mounting groove.

16. The laundry treating apparatus of claim 14, wherein the insertion groove is located in the outer support surface.

17. The laundry treating apparatus of claim 13, wherein the insertion groove is recessed in a direction perpendicular to the pressing direction of the push portion.

18. The laundry treating apparatus of claim 1, wherein the fixing portion includes:

a fixing body;

a locking hook protruding downwardly from the fixing body to be selectively inserted into the mounting portion; and an elastic portion connecting the fixing body to the locking hook.

19. The laundry treating apparatus of claim 18, wherein the storage further includes:

a storage body detachably mounted to the mounting portion, the storage body being configured to store the detergent therein:

a plate located under the storage body, the plate being configured to be detachably seated on the mounting portion;

a hook insertion hole defined in the plate, the hook insertion hole being configured to receive the locking hook therein; and guide ribs located on opposite sides of the hook insertion hole to guide the locking hook to move only in a height direction.

20. The laundry treating apparatus of claim 1, wherein the storage includes a storage body detachably mounted to the mounting portion, the storage body being configured to store the detergent therein, wherein the mounting portion further includes an insertion groove at a portion of a top surface of the mounting portion facing the storage body, and wherein the fixing portion is configured to be inserted into the insertion groove.

* * * * *